US009527298B2

(12) United States Patent
Nakata

(10) Patent No.: US 9,527,298 B2
(45) Date of Patent: Dec. 27, 2016

(54) LIQUID SUPPLY UNIT

(71) Applicant: Seiko Epson Corporation, Tokyo (JP)

(72) Inventor: Satoshi Nakata, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/836,279

(22) Filed: Aug. 26, 2015

(65) Prior Publication Data

US 2016/0059575 A1 Mar. 3, 2016

(30) Foreign Application Priority Data

Aug. 29, 2014 (JP) ..... 2014-175151
Jul. 1, 2015 (JP) ..... 2015-132429

(51) Int. Cl.
*B41J 2/175* (2006.01)
*B41J 2/14* (2006.01)

(52) U.S. Cl.
CPC ..... *B41J 2/1752* (2013.01); *B41J 2/1753* (2013.01); *B41J 2/17546* (2013.01); *B41J 2/17553* (2013.01)

(58) Field of Classification Search
CPC ... B41J 2/1752; B41J 2/17553; B41J 2/17523; B41J 2/17526; B41J 2/17503; B41J 2/1753; B41J 2/175
USPC ..... 347/50, 85, 86
See application file for complete search history.

(56) References Cited

U.S. PATENT DOCUMENTS 8,297,738 B1 10/2012 Kodama et al.
2007/0052774 A1 3/2007 Simizu et al.
2014/0218448 A1* 8/2014 Mizutani ..... B41J 2/1752 347/86
2015/0077486 A1 3/2015 Kodama et al.

FOREIGN PATENT DOCUMENTS

JP 2007-230249 A 9/2007
JP 2013-141804 A 7/2013
JP 2013-163364 A 8/2013
JP 5218712 B1 8/2013

* cited by examiner

*Primary Examiner* — Jannelle M Lebron

(57) ABSTRACT

A new engagement mechanism is provided that enables a liquid supply unit to be removed from an on-carriage holder. The liquid supply unit includes a first face, a second face opposed to the first face, a third face intersecting the first face and the second face, a fourth face intersecting the first face and the second face and opposed to the third face, a liquid supply portion, a first engaging portion projecting from the first face and capable of engaging with the on-carriage holder, and an operation portion provided on the second face.

7 Claims, 16 Drawing Sheets

20c
204
202
203
220
40
208
205(206)
280
201

20d
204
202
203
220
40
208
205(206)
280
201

20e
204
202
203
220
40
208
205(206)
280
201

20f
204
202
203
220
40
208
205(206)
280
201

20g
204
202
203
220
208
40
205(206)
280
201

20h
204
202
203
220
208h
40
205(206)
280
201

LIQUID SUPPLY UNIT

BACKGROUND

1. Technical Field

The present invention relates to liquid supply units to be attached to carriage units of liquid ejection apparatuses.

2. Related Art

Printers have been widely used as a kind of liquid ejection apparatuses, and ink cartridges are used as liquid supply units for the printers. Hitherto, various engagement mechanisms for attaching and detaching the ink cartridges to/from the printers have been proposed. For example, a technique of providing a lever serving as the engagement mechanism on a side wall of an ink cartridge is known (JP-A-2007-230249). In this known technique, upon attaching the ink cartridge to a holder, the lever of the ink cartridge engages with an engaging portion of the holder and fixed. At the time of detachment, the engagement between the ink cartridge and the engaging portion is cancelled by a user pressing the lever, and the ink cartridge can be detached from the holder. A technique of providing a lever serving as an engagement mechanism in a holder on a carriage of a printer is also known (JP-A-2013-141804). In this known technique, upon attaching the ink cartridge to a holder, an engaging portion of the ink cartridge engages with the lever of the holder and fixed. At the time of detachment, the engagement between the ink cartridge and the lever is cancelled by a user pressing the lever, and the ink cartridge can be detached from the holder.

If the size of the lever is further reduced similarly to a reduction in size of ink cartridges, there is a possibility that the operability of the lever is lost. For this reason, there has been difficulty in providing a lever such as one described in JP-A-2007-230249 on a side wall of an ink cartridge in some cases. Meanwhile, even if a lever is provided in a holder on a carriage of a printer as in JP-A-2013-141804, there has been cases where a user feels difficulty in correctly recognizing the position at which the user presses the lever, or correctly pressing the lever, since the lever has been becoming smaller and smaller with the reduction in size of ink cartridges. For this reason, provision of a new engagement mechanism that does not exist in known techniques has been demanded. This problem is not limited to the ink cartridges for printers, but is also a problem shared by liquid supply systems for other kinds of liquid ejection apparatuses.

SUMMARY

The invention has been made in order to solve at least a part of the foregoing problem, and can be achieved as the following modes or application examples.

(1) According to a first mode of the invention, a liquid supply unit to be attached to an on-carriage holder of a liquid ejection apparatus is provided. This liquid supply unit includes: a first face; a second face opposed to the first face; a third face intersecting the first face and the second face; a fourth face intersecting the first face and the second face and opposed to the third face; a liquid supply portion; a first engaging portion projecting from the first face and capable of engaging with the on-carriage holder; and an operation portion provided on the second face.

According to the first mode, the engagement between the first engaging portion and the on-carriage holder can be cancelled using the operation portion provided on the second face of the liquid supply unit. Accordingly, the liquid supply unit can be removed from the on-carriage holder by a new engagement mechanism that does not exist in known techniques.

In an embodiment, the liquid supply portion may be configured to project from the first face in the direction extending from the second face toward the first face, and to be biased in the direction extending from the first face toward the second face by the on-carriage holder in a state where the liquid supply unit is attached to the on-carriage holder. The first engaging portion may be configured to project from the first face in the direction extending from the second face toward the first face, and to be able to restrict the movement of the liquid supply unit in the direction extending from the first face toward the second face within the on-carriage holder in a state where the liquid supply unit is attached to the on-carriage holder. The operation portion may be configured to be provided on the second face, and to be able to cancel the engagement between the first engaging portion and the on-carriage holder. However, these configurations can be omitted or modified.

(2) The above liquid supply unit may further include a second engaging portion projecting from the fourth face in a direction extending from the third face toward the fourth face, the second engaging portion being able to restrict movement of the liquid supply unit in the direction extending from the first face toward the second face within the on-carriage holder in a state where the liquid supply unit is attached to the on-carriage holder.

With this configuration, the liquid supply unit can be more reliably engaged with the on-carriage holder by the two engaging portions that are the first engaging portion and the second engaging portion.

(3) The above liquid supply unit may further include an electric terminal portion arranged between the first face and the third face. The electric terminal portion may be biased in the direction extending from the first face toward the second face by the on-carriage holder in a state where the liquid supply unit is attached to the on-carriage holder. The first engaging portion may be located between the liquid supply portion and the electric terminal portion in a direction extending from the third face toward the fourth face.

With this configuration, since the first engaging portion is located near the electric terminal portion, the electrical contact of the electric terminal portion can be stabilized.

(4) According to a second mode of the invention, a liquid supply unit to be attached to an on-carriage holder of a liquid ejection apparatus is provided. This liquid supply unit include: a liquid containing chamber capable of containing liquid; a liquid supply portion coming into contact with the on-carriage holder and capable of supplying the liquid to the on-carriage holder; an electric terminal portion capable of being electrically connected to the on-carriage holder; and a first engaging portion capable of engaging with the on-carriage holder. In a state where the liquid supply unit is attached to the on-carriage holder, the liquid supply portion is biased in a first direction by the on-carriage holder, the electric terminal portion is biased in the first direction by the on-carriage holder, the first engaging portion can restrict movement of the liquid supply unit in the first direction within the on-carriage holder, the first engaging portion is located between the liquid supply portion and the electric terminal portion in a second direction intersecting the first direction, the first engaging portion is located in the liquid supply unit on the side in a third direction opposite to the first direction, and an operation portion capable of cancelling engagement between the first engaging portion and the on-carriage holder is located in the liquid supply unit on the side in the first direction.

According to the second mode, the engagement between the first engaging portion and the on-carriage holder can be cancelled using the operation portion provided in the liquid supply unit on the side in the first direction. Accordingly, the liquid supply unit can be removed from the on-carriage holder by a new engagement mechanism that does not exist in known techniques.

(5) The above liquid supply unit may further include a second engaging portion capable of engaging with the on-carriage holder. The second engaging portion can restrict movement of the liquid supply unit in the first direction within the on-carriage holder. The liquid supply portion may be located between the first engaging portion and the second engaging portion in the second direction.

With this configuration, the liquid supply unit can be more reliably engaged with the on-carriage holder by the two engaging portions that are the first engaging portion and the second engaging portion. Furthermore, since the liquid supply portion is located between the first engaging portion and the second engaging portion, an engaging state can be achieved where the liquid supply portion can resist biasing force received from the on-carriage holder in a balanced manner with these two engaging portions.

(6) According to a third mode of the invention, a liquid supply unit to be attached to an on-carriage holder of a liquid ejection apparatus is provided. This liquid supply unit includes: a first face; a second face opposed to the first face; a third face intersecting the first face and the second face; a fourth face intersecting the first face and the second face and opposed to the third face; a liquid supply portion; and an engagement structure capable of engaging with the on-carriage holder. The engagement structure includes an operation portion capable of cancelling engagement between the engagement structure and the on-carriage holder.

According to the third mode, the engagement between the engagement structure and the on-carriage holder can be cancelled using the operation portion. Accordingly, the liquid supply unit can be removed from the on-carriage holder by a new engagement mechanism that does not exist in known techniques.

In an embodiment, the liquid supply portion may be configured to project from the first face in the direction extending from the second face toward the first face, and to be biased in the direction extending from the first face toward the second face by the on-carriage holder in a state where the liquid supply unit is attached to the on-carriage holder. The engagement structure may be configured such that a part of the engagement structure projects from the first face in the direction extending from the second face toward the first face, and configured to be able to restrict movement of the liquid supply unit in the direction extending from the first face toward the second face within the on-carriage holder in a state where the liquid supply unit is attached to the on-carriage holder. However, these configurations can be omitted or modified.

(7) The above liquid supply unit may further include a second engaging portion projecting from the fourth face in a direction extending from the third face toward the fourth face, the second engaging portion being able to restrict movement of the liquid supply unit in the direction extending from the first face toward the second face within the on-carriage holder in a state where the liquid supply unit is attached to the on-carriage holder.

With this configuration, the liquid supply unit can be more reliably engaged with the on-carriage holder by the two engaging portions that are the first engaging portion and the second engaging portion.

(8) The above liquid supply unit may further include an electric terminal portion arranged between the first face and the third face. The electric terminal portion may be biased in the direction extending from the first face toward the second face by the on-carriage holder in a state where the liquid supply unit is attached to the on-carriage holder. The engagement structure may be located between the liquid supply portion and the electric terminal portion in a direction extending from the third face toward the fourth face.

With this configuration, since the first engaging portion is located near the electric terminal portion, the electrical contact of the electric terminal portion can be stabilized.

(9) In the above liquid supply unit, the engagement structure may have a first leg portion, the first leg portion may have a first engaging shape portion capable of restricting movement of the liquid supply unit in the direction extending from the first face toward the second face within the on-carriage holder in a state where the liquid supply unit is attached to the on-carriage holder; and the operation portion may be able to cancel engagement between the first engaging shape portion and the on-carriage holder.

With this configuration, the engagement between the first engaging shape portion and the on-carriage holder can be cancelled using the operation portion.

(10) In the above liquid supply unit, the engagement structure may further have a second leg portion. The second leg portion may have a second engaging shape portion capable of restricting movement of the liquid supply unit in the direction extending from the first face toward the second face within the on-carriage holder in a state where the liquid supply unit is attached to the on-carriage holder. The operation portion may be able to cancel engagement between the second engaging shape portion and the on-carriage holder.

With this configuration, the engagement between the first and second engaging shape portions and the on-carriage holder can be cancelled using the operation portion.

(11) In the above liquid supply unit, the operation portion may be exposed from the second face in the direction extending from the first face toward the second face.

With this configuration, since the operation portion is exposed from the second face, a user can easily operate the operation portion.

(12) In the above liquid supply unit, in a state where the liquid supply unit is attached to the on-carriage holder, the first leg portion may be pressed and fixed as a result of the operation portion being moved in the direction extending from the second face toward the first face. The first leg portion may be released from a pressed state and fixation may be cancelled as a result of the operation portion being moved in the direction extending from the first face toward the second face.

With this configuration, the first leg portion can be fixed and released by performing an operation of moving the operation portion in the direction extending from the second face toward the first face, and moving the operation portion in the opposite direction.

(13) In the above liquid supply unit, the operation portion may be linked to the first leg portion. In a state where the liquid supply unit is attached to the on-carriage holder, as a result of the operation portion being rotated in a first rotation direction, the first leg portion may be rotated, and the first engaging shape portion may be moved to a position at which the first engaging shape portion engages with the on-carriage holder. As a result of the operation portion being rotated in a second rotation direction opposite to the first rotation direction, the first leg portion may be rotated, and the first engaging shape portion may be moved to a position at which the first engaging shape portion does not engage with the on-carriage holder.

With this configuration, the first leg portion can be fixed and released by performing an operation of rotating the operation portion in the first rotation direction and rotating the operation portion in the second rotation direction opposite to the first rotation direction.

(14) According to a fourth mode of the invention, a liquid supply unit to be attached to an on-carriage holder of a liquid ejection apparatus is provided. This liquid supply unit includes: a liquid containing chamber capable of containing liquid; a liquid supply portion coming into contact with the on-carriage holder and capable of supplying the liquid to the on-carriage holder; an electric terminal portion capable of being electrically connected to the on-carriage holder; and an engagement structure capable of engaging with the on-carriage holder. The engagement structure includes an operation portion capable of cancelling engagement between the engagement structure and the on-carriage holder. In a state where the liquid supply unit is attached to the on-carriage holder, the liquid supply portion is biased in a first direction by the on-carriage holder, the electric terminal portion is biased in the first direction by the on-carriage holder, the engagement structure can restrict movement of the liquid supply unit in the first direction within the on-carriage holder, and the engagement structure is located between the liquid supply portion and the electric terminal portion in a second direction intersecting the first direction.

According to the fourth mode, the engagement between the engagement structure and the on-carriage holder can be cancelled using the operation portion provided in the liquid supply unit. Accordingly, the liquid supply unit can be removed from the on-carriage holder by a new engagement mechanism that does not exist in known techniques. Furthermore, the engagement structure is located between the liquid supply portion and the electric terminal portion in the second direction intersecting the first direction, and the engagement structure is located near the electric terminal portion. Accordingly, the electrical contact of the electric terminal portion can be stabilized.

(15) The above liquid supply unit may further include a second engaging portion capable of engaging with the on-carriage holder. The second engaging portion may be able to restrict movement of the liquid supply unit in the first direction within the on-carriage holder, and the liquid supply portion may be located between the engagement structure and the second engaging portion in the second direction.

With this configuration, the liquid supply unit can be more reliably engaged with the on-carriage holder by the engagement structure and the second engaging portion.

(16) In the above liquid supply unit, the engagement structure may have a first leg portion. The first leg portion may have a first engaging shape portion capable of restricting movement of the liquid supply unit in the first direction within the on-carriage holder in a state where the liquid supply unit is attached to the on-carriage holder. The operation portion may be able to cancel engagement between the first engaging shape portion and the on-carriage holder.

With this configuration, the engagement between the first engaging shape portion and the on-carriage holder can be cancelled using the operation portion.

(17) In the above liquid supply unit, the engagement structure may further have a second leg portion. The second leg portion may have a second engaging shape portion capable of restricting movement of the liquid supply unit in the first direction within the on-carriage holder in a state where the liquid supply unit is attached to the on-carriage holder. The operation portion may be able to cancel engagement between the second engaging shape portion and the on-carriage holder.

With this configuration, the engagement between the first and second engaging shape portions and the on-carriage holder can be cancelled using the operation portion.

(18) In the above liquid supply unit, the operation portion may be able to be accessed in a third direction opposite to the first direction.

With this configuration, since the operation portion is configured to be able to be accessed from the third direction, the user can easily operate the operation portion.

(19) In the above liquid supply unit, the first leg portion may be pressed and fixed as a result of the operation portion being moved in a third direction opposite to the first direction in a state where the liquid supply unit is attached to the on-carriage holder. The first leg portion may be released from a pressed state and fixation is cancelled as a result of the operation portion being moved in the first direction.

With this configuration, the first leg portion can be fixed and released by performing an operation of moving the operation portion in the third direction and moving the operation portion in the first direction opposite to the third direction.

(20) In the above liquid supply unit, the operation portion may be linked to the first leg portion. In a state where the liquid supply unit is attached to the on-carriage holder, as a result of the operation portion being rotated in a first rotation direction, the first leg portion may be rotated, and the first engaging shape portion may be moved to a position at which the first engaging shape portion engages with the on-carriage holder. As a result of the operation portion being rotated in a second rotation direction opposite to the first rotation direction, the first leg portion may be rotated, and the first engaging shape portion may be moved to a position at which the first engaging shape portion does not engage with the on-carriage holder.

With this configuration, the first leg portion can be fixed and released by performing an operation of rotating the operation portion in the first rotation direction and rotating the operation portion in the second rotation direction opposite to the first rotation direction.

The invention can be achieved in various modes, and for example, the invention can be achieved not only as a liquid supply unit but also in various modes such as a liquid ejection apparatus including a liquid supply unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

Figure 1:
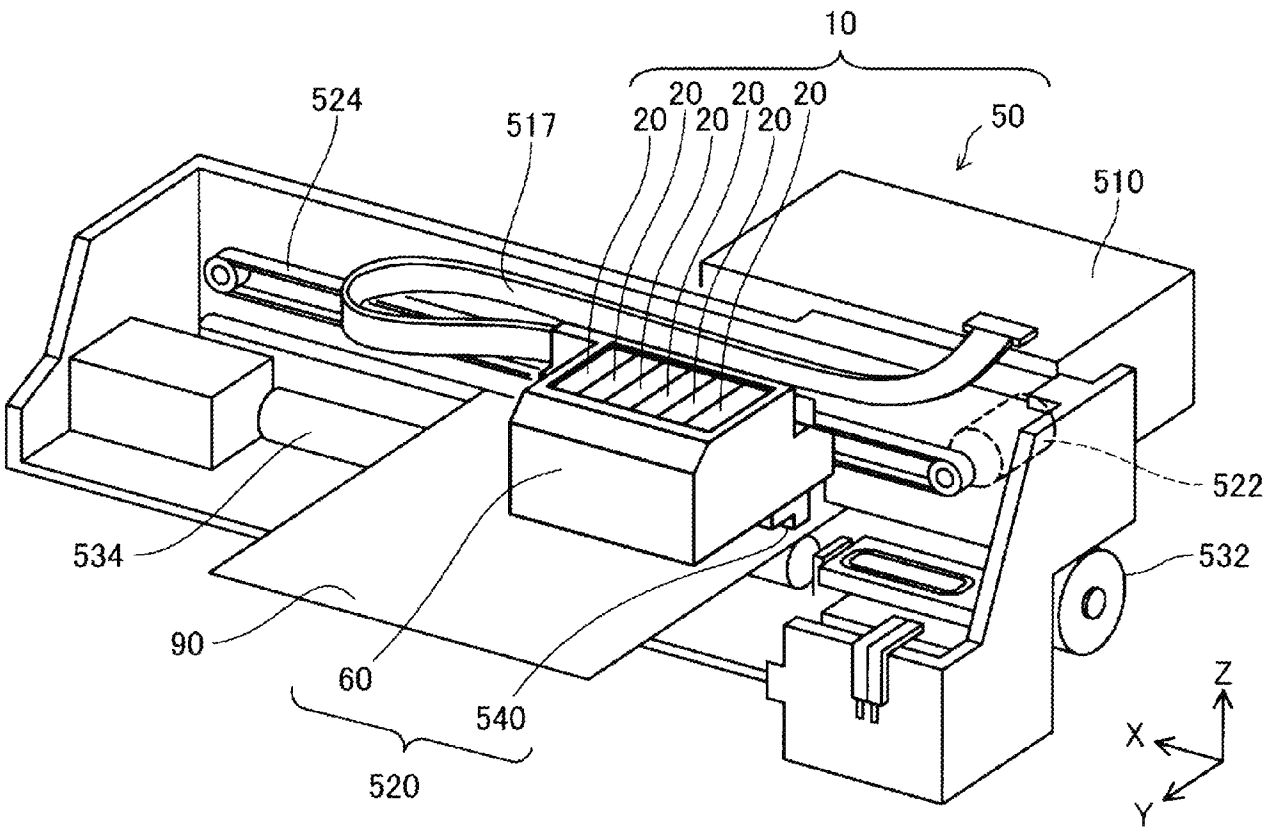
FIG. 1 is a perspective view of a liquid ejection system.

FIG. 1 is a perspective view of a liquid ejection system 10 in an embodiment of the invention. In FIG. 1, XYZ axes orthogonal to one another are indicated. The XYZ axes in FIG. 1 correspond to XYZ axes in the other diagrams. The XYZ axes are also given as necessary in the subsequent diagrams. The liquid ejection system 10 includes ink cartridges 20 each serving as a liquid supply unit, and a printer 50 serving as a liquid ejection apparatus.

The printer 50 includes a control unit 510 and a carriage unit 520. The carriage unit 520 includes a print head 540 and an on-carriage holder 60. The ink cartridges 20 are detachably attached to the on-carriage holder 60 by a user. Note that the ink cartridges 20 will also be called "cartridges". The on-carriage holder 60 will also be called a "holder", a "holder unit", or a "cartridge attaching portion".

The control unit 510 in the printer 50 controls each part of the printer 50. The carriage unit 520 is configured to be able to relatively move the print head 540 with respect to a print medium 90. The control unit 510 and the carriage unit 520 are electrically connected to each other via a flexible cable 517. The print head 540 operates based on a control signal from the control unit 510, and discharges ink to the print medium 90 such as paper or a label. Characters, diagrams, images, or the like are thereby printed on the print medium 90.

A printer such as the printer 50 in this embodiment in which the ink cartridges 20 are attached to the holder 60 of the carriage unit 520 is also called a printer of an "on-carriage type". In another embodiment, a configuration may be employed in which an unmovable stationary cartridge holder (off-carriage holder) is installed in a portion different from the position of the carriage unit 520, and ink is supplied from ink cartridges attached to this off-carriage holder to the print head 540 in the carriage unit 520 via a flexible tube. This type of printer is also called an "off-carriage type".

The printer 50 includes a main scan feeding mechanism and a sub-scan feeding mechanism for relatively moving the carriage unit 520 and the print medium 90. The main scan feeding mechanism includes a carriage motor 522 and a drive belt 524, for example, and moves the carriage unit 520 back and forth in a main scanning direction by transmitting power of the carriage motor 522 to the carriage unit 520 via the drive belt 524. The sub-scan feeding mechanism includes a conveyance motor 532 and a platen 534, for example, and conveys the print medium 90 in a sub-scanning direction that is orthogonal to the main scanning direction, by transmitting the power of the conveyance motor 532 to the platen 534. The carriage motor 522 in the main scan feeding mechanism and the conveyance motor 532 in the sub-scan feeding mechanism operate based on a control signal from the control unit 510.

In this specification, when the liquid ejection system 10 is in a state of being used (also referred to as a "posture of being used"), the axis along the main scanning direction (left-right direction) in which the carriage unit 520 is moved back and forth is assumed to be the X axis, the axis along the sub-scanning direction (front-rear direction) in which the print medium 90 is conveyed is assumed to be the Y axis, and the axis along the gravity direction (up-down direction) is assumed to be the Z axis. The state of the liquid ejection system 10 being used is the state of the liquid ejection system 10 installed on a horizontal plane, and the horizontal plane is a plane (XY plane) parallel with the Y axis and the X axis. Note that the sub-scanning direction (forward direction) is assumed to be a +Y direction, the direction (backward direction) opposite thereto is assumed to be a −Y direction, the direction (upward direction) extending upward from below in the gravity direction is assumed to be a +Z direction, and the direction (downward direction) opposite thereto is assumed to be a −Z direction. The side (front side) of the liquid ejection system 10 in the +Y direction is the front face of the liquid ejection system 10. The direction extending from the right side face toward the left side face of the liquid ejection system 10 is assumed to be a +X direction (leftward direction), and the direction opposite thereto is assumed to be a −X direction (rightward direction). The arranging direction of the plurality of cartridges 20 attached to the holder 60 is a direction parallel with the X axis. The +Z direction will also be called a "first direction", the +−Y direction will also be called a "second direction", and the −Z direction will also be called a "third direction".

The ink cartridges 20 contain ink serving as a print agent. The ink contained in the cartridges 20 is supplied to the print head 540 via a later-described ink supply port and ink supply tube. The plurality of cartridges 20 are detachably attached to the holder 60. In this embodiment, six types of cartridges 20 corresponding to six colors (black, yellow, magenta, light magenta, cyan, and light cyan) of ink are attached one by one, i.e., a total of six cartridges 20 are attached to the holder 60. However, the number of cartridges 20 that can be attached to the holder 60 and the ink type can be set in any manner. A detailed configuration of the cartridges 20 and the holder 60 will be described later.

Figure 2:
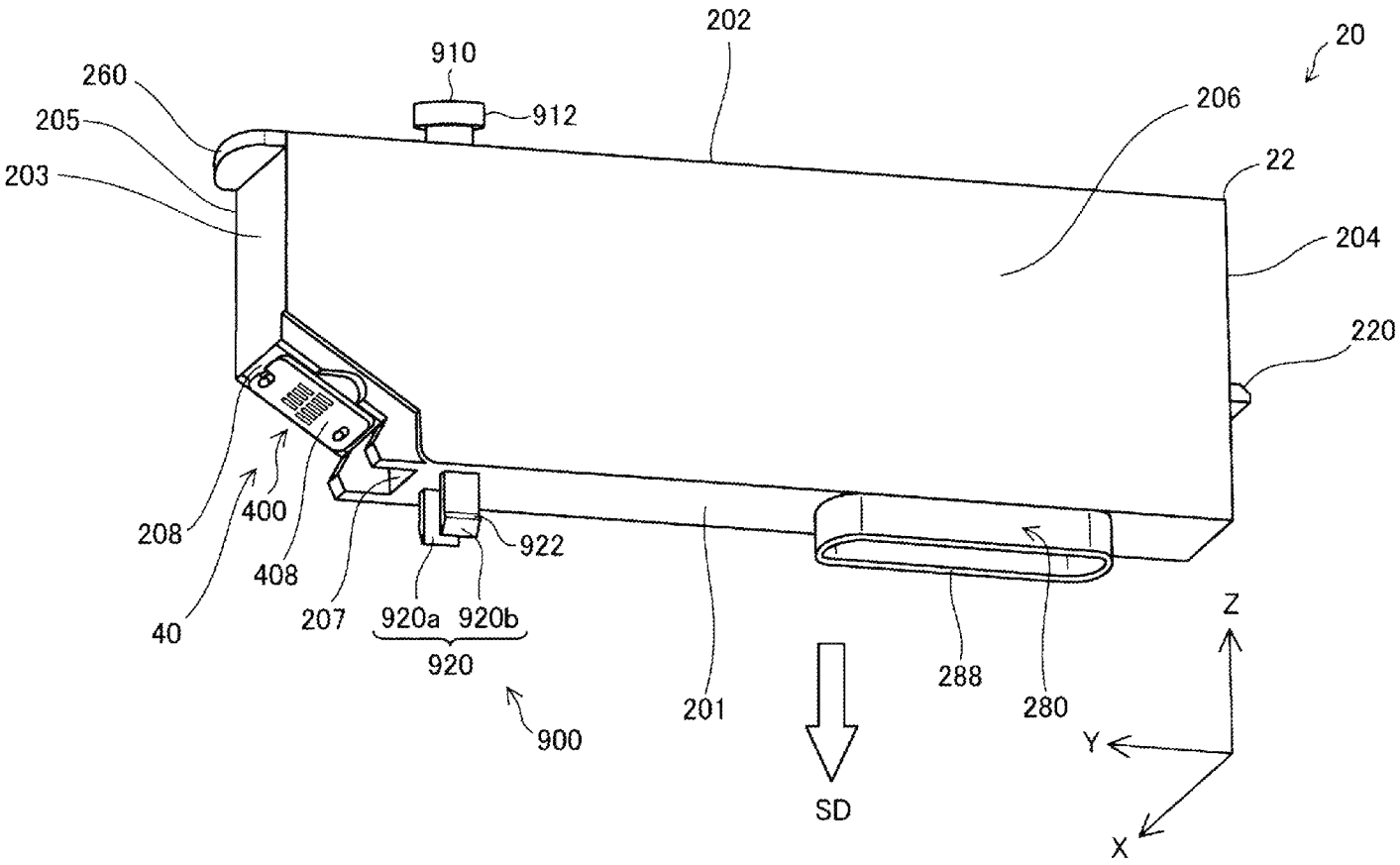
FIG. 2 is a perspective view of an ink cartridge in a first embodiment.

FIG. 2 is a perspective view of the ink cartridge 20. This cartridge 20 includes an outer shell 22, an ink supply port 280, a circuit board 40, an engagement structure 900, and a projecting portion 260. The engagement structure 900 is a structure for engaging the cartridge 20 with the holder 60, and has an operation portion 910 and a first engaging portion 920. The first engaging portion 920 has a first leg portion 920*a* and a second leg portion 920*b*. These leg portions 920*a* and 920*b* each have an engaging shape portion 922 having a projection shape. Although the engaging shape portion 922 is an engaging projection in this example, an engaging shape portion having other shapes such as an engaging recess portion is also available. An attaching direction SD at the time of attaching the cartridge 20 to the holder 60 is the −Z direction. Note that the outer shell 22 will also be called a "cartridge body". The ink supply port 280 will also be called a "liquid supply portion".

The outer shell 22 demarcates and defines an inside space including an ink containing portion (liquid containing chamber) of the cartridge 20. The outer shell 22 constitutes at least a part of the outer wall face of the cartridge 20. The outer shell 22 is formed by synthetic resin such as polypropylene (PP). The cartridge 20 has a substantially prism shape or a substantially rectangular parallelepiped shape. Note that a part of the outer shell 22 may be formed by a resin film.

The outer shell 22 has a first wall 201, a second wall 202, a third wall 203, a fourth wall 204, a fifth wall 205 (a wall on the side opposite to the sixth wall), a sixth wall 206, a seventh wall 207, and an eighth wall 208. In the following description, reference numerals 201 to 208 will also be used as numerals meaning outer surfaces (first to eighth faces 201 to 208) of walls constituting the outer shell 22 of the cartridge. Each of the first face 201 to the eighth face 208 is a substantially flat face. "Substantially flat face" encompasses the case where the entire face is completely flat and the case where a part of the face is uneven. That is to say, it encompasses the case where even if a part of the face is more or less uneven, the face and the wall constituting the outer shell of the cartridge 20 can be perceived. The outer shapes of all of the first face 201 to the eighth face 208 in a plan view are substantially rectangle.

The first face 201 is a face that serves as a bottom face in an attached state, and is a horizontal face. That is to say, the first face 201 is a face (XY plane) parallel with the Y axis and the X axis and vertical to the Z axis.

The second face 202 is a face that serves as an upper face in the attached state. The second face is opposed to the first face 201. The second face 202 is a face parallel with the first face 201. That is to say, the second face 202 is a face parallel with the Y axis and the X axis and vertical to the Z axis. The second face 202 is a horizontal face (XY plane) in the attached state.

The third face 203 is a face that serves as a front face in the attached state. The third face 203 is a face intersecting the first face 201 and the second face 202. The third face 203 is a face (XZ plane) parallel with the X axis and the Z axis and vertical to the Y axis. Note that in this specification, two faces "intersecting each other" means that the two faces are in one of a state of actually intersecting each other, a state where an extended face of one face intersects the other face, and a state where extended faces of the two faces intersect each other.

The fourth face 204 is a face that serves as a back face in the attached state. The fourth face 204 is a face intersecting the first face 201 and the second face 202. The fourth face 204 is a face parallel with the third face 203. The fourth face 204 is a face (XZ plain) parallel with the X axis and the Z axis and vertical to the Y axis.

The fifth face 205 is a face that serves as a left side face in the attached state, and the sixth face 206 is a face that serves as a right side face in the attached state. The fifth face 205 and the sixth face 206 are faces each intersecting the first to fourth faces 201 to 204. The fifth face 205 and the sixth face 206 are faces (YZ planes) parallel with the Y axis and the Z axis and vertical to the X axis. The sixth face 206 is a face parallel with the fifth face 205.

The seventh face 207 and the eighth face 208 are faces connecting the first face 201 and the third face 203. The seventh face 207 is a face intersecting the first face 201. The seventh face 207 is a face (XZ plain) parallel with the X axis and the Z axis. The seventh face 207, which serves as a step face, is a face erected with respect to the first face 201. That is to say, the seventh face 207 is a face extending from the first face 201 in the +Z direction. The seventh face 207 is located on the side in the −Y direction and the side in the −Z direction with respect to the eighth face 208. The eighth face 208 is a face connecting the seventh face 207 and the third face 203. The eighth face 208 is an inclined face that inclines while facing in a direction containing a +Y direction component and a −Z direction component. The eighth face 208 is a face that inclines with respect to the first face 201 and the third face 203. The eighth face 208 is a face intersecting the fifth face 205 and the sixth face 206. The eighth face 208 inclines with respect to an XY plane and an XZ plane, and intersects a YZ plane at a right angle. A normal vector of the eighth face 208 can be decomposed into a +Y direction component and a −Z direction component.

The circuit board 40 is installed on the eighth face 208. A normal vector of a surface 408 of the circuit board 40 can also be decomposed into a +Y direction component and a −Z direction component, similarly to the eighth face 208. The surface 408 is a face that inclines with respect to the first face 201 and the third face 203. The surface 408 is a face intersecting the fifth face 205 and the sixth face 206. The surface 408 inclines with respect to an XY plane and an XZ plane, and intersects a YZ plane at a right angle. The surface 408 can also be called an "inclined face 408". The surface 408 is provided with a cartridge-side electric terminal group 400. The back side of the circuit board 40 is provided with an electric device (not shown) such as a storage device. This electric device is connected to the cartridge-side electric terminal group 400 by interconnection. For example, information regarding ink in the cartridge 20 (the amount of remaining ink, ink color) or the like is stored in the storage device. The circuit board 40 will also be called an "electric terminal portion 40".

The ink supply port 280 is provided so as to project from the first face 201 toward the side in the −Z direction. The later-described ink supply tube of the printer 50 is connected to the ink supply port 280, which causes the ink in the cartridge 20 to flow to the print head 540. That is to say, the ink supply port 280 opens toward the outside, and causes the ink in the cartridge 20 to flow to the outside. The ink supply port 280 is provided in a portion of the first face 201 that is closer to the fourth face 204 than to the third face 203. That is to say, the distance in the Y direction between the outer surface of the ink supply port 280 and the third face 203 is larger than the distance in the Y direction between the outer surface of the ink supply port 280 and the fourth face 204.

The leading end of the ink supply port 280 opens. A face (opening face) 288 formed by this opening is a horizontal face in the attached state. That is to say, the opening face 288 is a face (XY plane) parallel with the Y axis and the X axis. When the cartridge 20 is shipped from the factory, the opening face 288 of the ink supply port 280 is sealed by a seal member (not shown) such as a cap or a film. The sealing member (not shown) for sealing the opening face 288 is removed from the cartridge 20 before attaching the cartridge 20 to the holder 60.

The first engaging portion 920 of the engagement structure 900 includes the first leg portion 920*a* and the second leg portion 920*b* that project in the −Z direction from the first face 201 of the cartridge 20. The leg portions 920*a* and 920*b* each have the engaging shape portion 922 having a projection shape. In this example, the two engaging shape portions 922 are configured as projecting portions facing outside (in the +X direction and the −X direction) in opposite orientations. However, alternatively, the engaging shape portions 922 may face inside and be opposed to each other. These engaging shape portions 922 engage with later-described apparatus-side first engaging portions within the holder 60 in a state where the cartridge 20 is attached to the holder 60, and thereby restrict movement of the cartridge 20 in the +Z direction. The operation portion 910 is provided on the second face 202 of the cartridge 20. This operation portion 910 is a member to be operated by the user, and is used when fixing the engagement between the first engaging portion 920 and the apparatus-side first engaging portions and cancelling the engagement. Since the operation portion 910 is provided on the second face 202 of the cartridge 20, the user can access the operation portion 910 in the −Z direction, resulting in an advantage that the user can easily operate the operation portion 910. Note that an engaging shape portion having other kinds of shape, such as an engaging recess portion, may be used in place of the engaging shape portion 922 having an engaging projection shape. The details of the structure of the engagement structure 900 including the operation portion 910 and the first engaging portion 920 and operations thereof will be described later.

The cartridge 20 further has a second engaging portion 220 provided on the fourth face 204. The second engaging portion 220 is a projection provided so as to project from the fourth face 204 toward the side in the −Y direction. The second engaging portion 220 has a function of restricting upward movement of the cartridge 20 (in the +Z direction), by engaging with a later-described apparatus-side second engaging portion within the holder 60 in a state where the cartridge 20 is attached to the holder 60.

Figure 3:
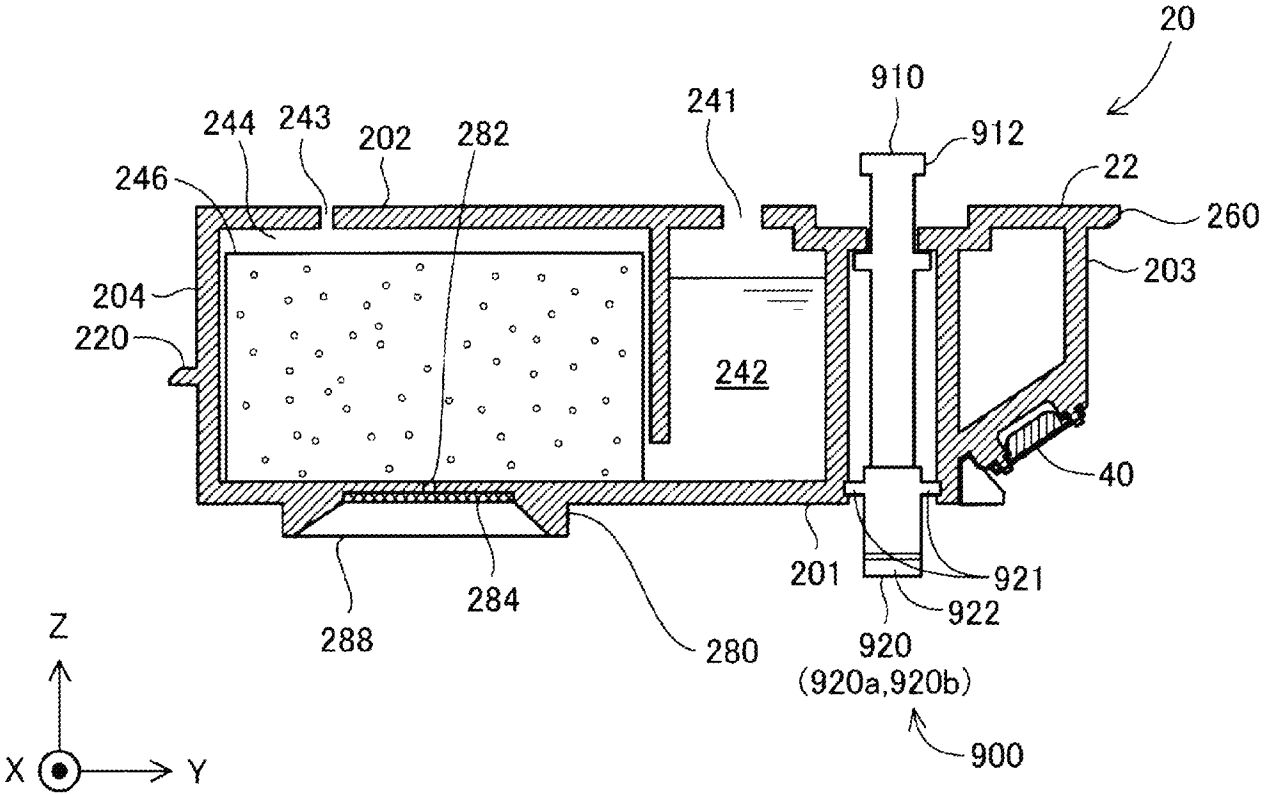
FIG. 3 is a cross-sectional view of a principal part of the ink cartridge in the first embodiment.

FIG. 3 is a cross-sectional view showing a principal part of the cartridge 20. Note that FIG. 3 shows the outer shape, rather than the cross-section, of the first engaging portion 920 and the operation portion 910 as viewed from the X direction, for the sake of convenience of the drawing. The two leg portions 920*a* and 920*b* are flat plate-shaped members extending in the Z direction, each provided with shafts 921 on both sides near the upper end thereof, and provided with the engaging shape portion 922 at the lower end thereof. The shafts 921 of the leg portions 920*a* and 920*b* are fitted into recess portions formed on a wall member of the outer shell 22, and pivotably supported. Lower end portions of the leg portions 920*a* and 920*b* can pivot in the +−X direction around the shafts 921. However, the first engaging portion 920 may be integrally formed with the outer shell 22. The operation portion 910 is a bar-shaped member extending in the Z direction, and is provided, at the upper end thereof, with a holding portion 912 to be held by fingers of the user. The user can hold this holding portion 912 to operate the operation portion 910 in the up-down direction (particularly in the upward direction). When the operation portion 910 is at the uppermost part in the movable area thereof (i.e., in the state in FIG. 3), the two leg portions 920*a* and 920*b* of the first engaging portion 920 are in a state of being able to pivot. When attaching the cartridge 20, the cartridge 20 is inserted into the holder 60 in this state, and the two leg portions 920*a* and 920*b* of the first engaging portion 920 are inserted into later-described through holes, which are the apparatus-side first engaging portions of the holder 60. On the other hand, upon pressing down the operation portion 910 to the lowermost part of the movable area thereof, movement of the leg portions 920*a* and 920*b* of the first engaging portion 920 is fixed, and the engaging state between the apparatus-side first engaging portions of the holder 60 and the first engaging portion 920 is fixed. When removing the cartridge 20, the engagement between the first engaging portion 920 and the apparatus-side first engaging portions can be cancelled by pulling up the operation portion 910. That is to say, the engagement between the first engaging portion 920 and the apparatus-side first engaging portions can be fixed and cancelled by operating the operation portion 910. This operation will be further described later.

An ink storage chamber 242 and an ink supply chamber 244 are demarcated between the first engaging portion 920 and the fourth face 204 of the cartridge 20. The ink storage chamber 242 and the ink supply chamber 244 will also be collectively called a "liquid containing chamber". Note that the liquid containing chamber does not need to be divided into the ink storage chamber 242 and the ink supply chamber 244.

An ink injection port 241 is formed at a position on the second face 202 of the cartridge 20 above the ink storage chamber 242. However, this ink injection port 241 is sealed with a sealing material or the like when the cartridge 20 is used. An atmosphere hole 243 is formed at a position on the second face 202 above the ink supply chamber 244. A porous ink holding member 246 is housed within the ink supply chamber 244. The ink supply chamber 244 is in communication with the ink supply port 280 via an ink flow hole 282. Foam resin 284 is arranged at the ink supply port 280.

Figure 4:
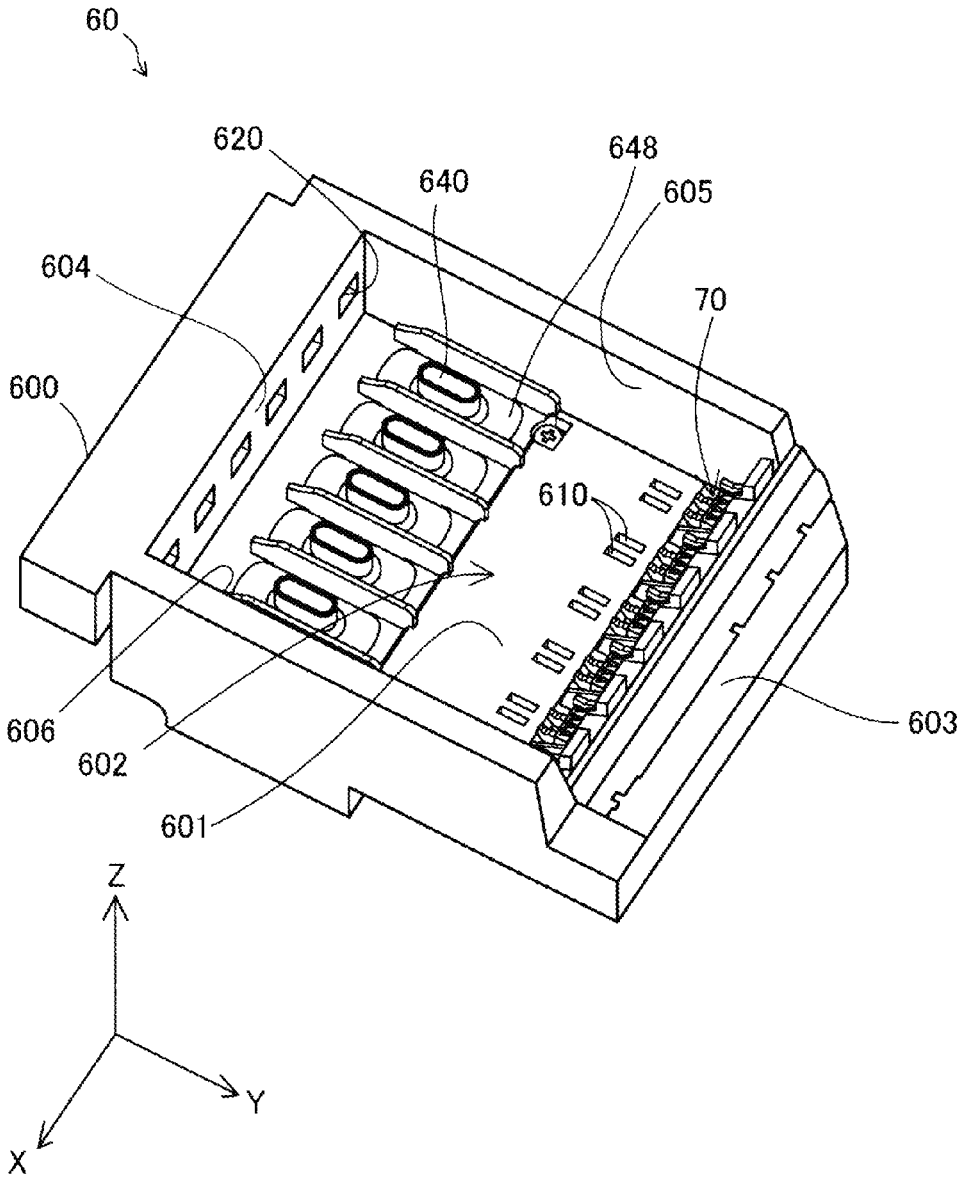
FIG. 4 is a perspective view of a cartridge holder.
Figure 5:
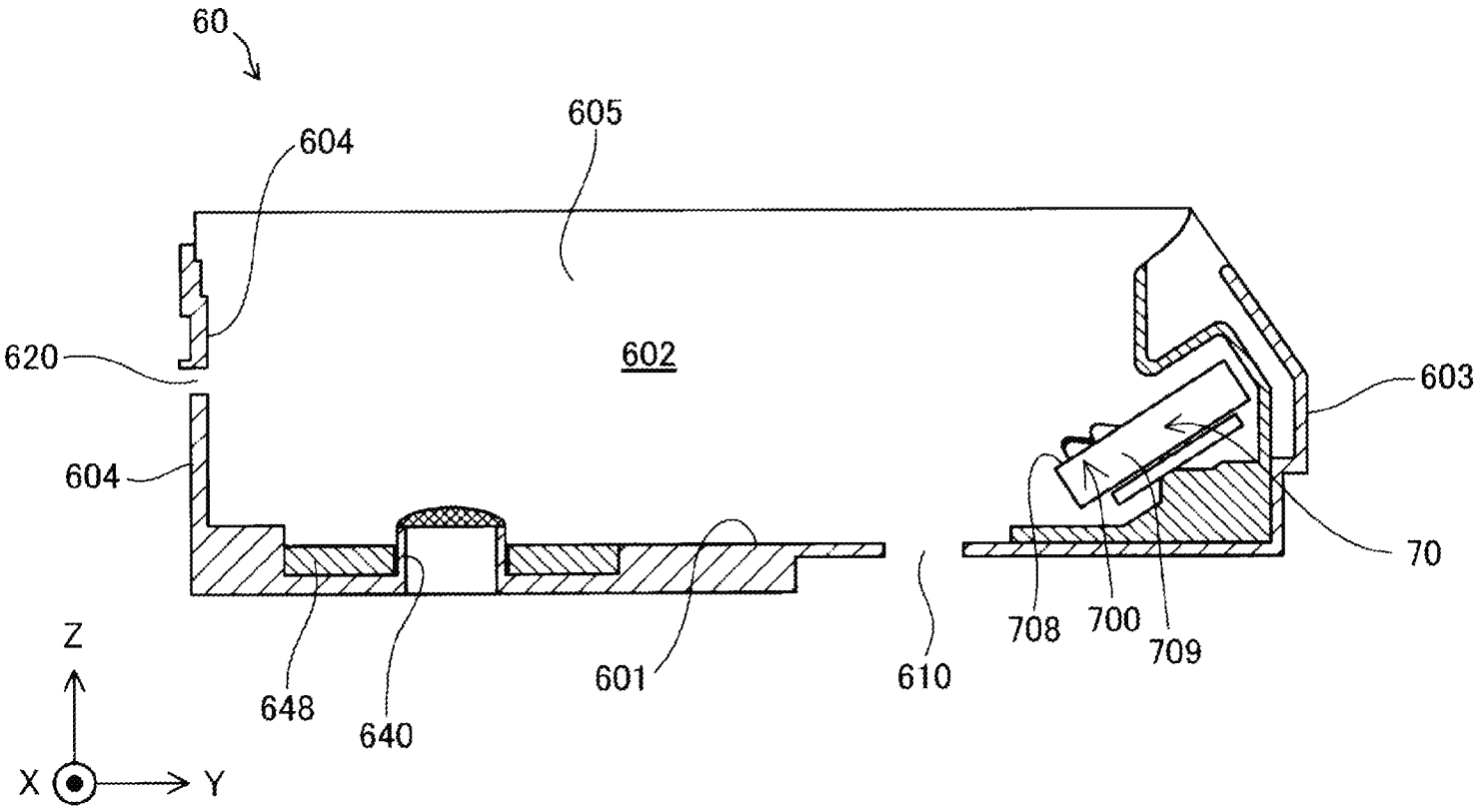
FIG. 5 is a cross-sectional view of a principal part of the cartridge holder.

FIG. 4 is a perspective view of the on-carriage holder 60, and FIG. 5 is a cross-sectional view of a principal part thereof. The holder 60 has five wall portions 601, 603, 604, 605, and 606 as wall faces defining a cartridge housing chamber 602 having a recess shape for receiving the cartridges 20. The five wall portions 601, 603, 604, 605, and 606 will be collectively called a "housing chamber forming wall portion 600". In this embodiment, the five wall portions 601, 603, 604, 605, and 606 are each formed by a synthetic resin plate-shaped member.

The wall portion 601 defines a bottom face of the cartridge housing chamber 602 having a recess shape. The wall portions 603, 604, 605, and 606 each define a side wall of the cartridge housing chamber 602 having a recess shape. The wall portion 601, the wall portion 603, the wall portion 604, the wall portion 605, and the wall portion 606 will also be called an "apparatus-side bottom wall portion 601", a "first apparatus-side side wall portion 603", a "second apparatus-side side wall portion 604", a "third apparatus-side side wall portion 605", and a "fourth apparatus-side side wall portion 606", respectively.

On the wall portion 601, ink supply tubes 640 and a contact point mechanism 70 including an apparatus-side terminal group are arranged in the Y direction. The ink supply tubes 640 are provided on the side closer to the wall portion 604 than to the wall portion 603. The contact point mechanism 70 is installed on the side closer to the wall portion 603 than the ink supply tubes 640 are.

An elastic member 648 is provided on the wall portion 601 around each ink supply tube 640. The elastic member 648 seals the periphery of the corresponding ink supply port 280 of the cartridge 20 in a state where the cartridge 20 is attached to the holder 60, and thereby prevents leakage of ink from the ink supply port 280 to the periphery thereof.

The elastic member 648 generates biasing force in a direction (+Z direction) of pushing back the ink supply port 280 of the cartridge 20 in a state where the cartridge 20 is attached to the holder 60.

A plurality of apparatus-side first engaging portions 610 are formed at positions on the wall portion 601 closer to the wall portion 603 than to the wall portion 604. In this example, a pair of apparatus-side first engaging portions 610 corresponding to one cartridge 20 are constituted by two through holes that penetrate the wall portion 601 in the Z direction. These through holes engage with the two leg portions 920*a* and 920*b* (FIG. 2) of the first engaging portion 920 of the corresponding cartridge 20. However, the pair of apparatus-side first engaging portions 610 corresponding to one cartridge 20 may be constituted by one through hole.

The wall portion 603 constitutes a front face of the holder 60. The wall portion 604 constitutes a back face of the holder 60. The wall portion 604 is provided with apparatus-side second engaging portions 620. In this example, the apparatus-side second engaging portions 620 are through holes that penetrate the wall portion 604 in the Y direction. Note that each apparatus-side second engaging portion 620 may be a recess portion that is open while facing the cartridge housing chamber 602. The wall portion 605 constitutes a right side face of the holder 60. The wall portion 606 constitutes a left side face of the holder 60.

The contact point mechanism 70 is provided at a corner portion at which the wall portion 601 and the wall portion 603 of the holder 60 intersect each other. The contact point mechanism 70 is installed further on the side of the wall portion 603 than the ink supply tubes 640 are. As shown in FIG. 5, the contact point mechanism 70 has a plurality of apparatus-side electric terminals 700 that correspond to and come into contact with a plurality of electric terminals of the circuit board 40 (FIG. 2) of the cartridge 20, and a terminal base 709 that holds the plurality of apparatus-side electric terminals 700. The apparatus-side electric terminals 700 project from an inclined face 708 of the terminal base 709. The apparatus-side electric terminals 700 generate biasing force in a direction of pushing back the circuit board 40 of the cartridge 20 (i.e., a direction including a +Z direction component and a −Y direction component) in a state where the cartridge 20 is attached to the holder 60. The direction of this biasing force is a direction substantially vertical to the inclined face 708 of the terminal base 709. That is to say, upon the apparatus-side electric terminals 700 projecting from the inclined face 708 being pressed toward the side of the inclined face 708 by the cartridge 20, the apparatus-side electric terminals 700 apply, as counterforce, biasing force in an oblique direction to the cartridge 20.

Figure 6A:
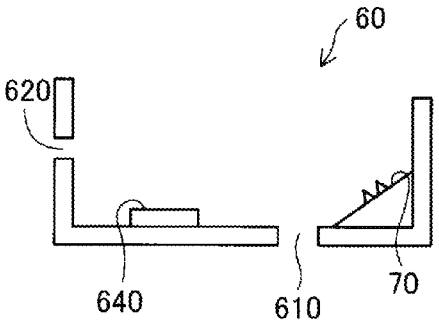
FIGS. 6A to 6C are illustrative views showing a state of attaching the cartridge to the holder.
Figure 6B:
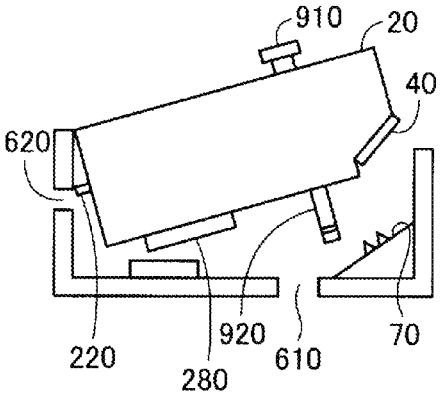
Figure 6C:
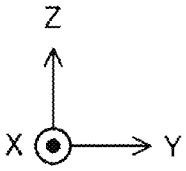
Figure 6C:
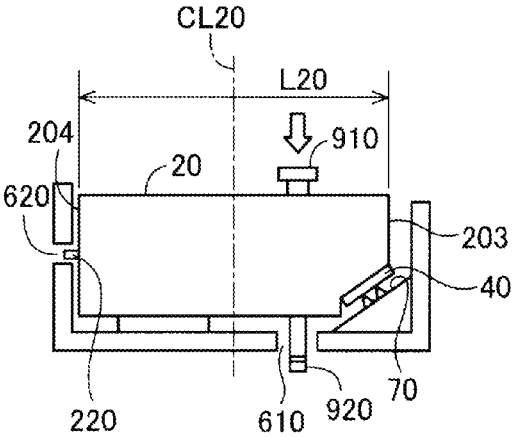

FIGS. 6A to 6C are illustrative views showing a state of attaching the cartridge 20 to the holder 60. Here, the outer shapes of the cartridge 20 and the holder 60 are simplified. When attaching the cartridge 20 into the holder 60, as shown in FIG. 6B, the cartridge 20 is caused to enter the inside of the holder 60 in an oblique posture with the rear end side (an end portion in the −Y direction) of the cartridge 20 slightly lowered. Then, the projection serving as the second engaging portion 220 formed on the fourth face 204 is inserted into the through hole serving as the apparatus-side second engaging portion 620 of the holder 60. The engagement between the second engaging portion 220 and the apparatus-side second engaging portion 620 restricts movement of the rear end side of the cartridge 20 in the +Z direction. Thereafter, as shown in FIG. 6C, the front end side of the cartridge 20 is lowered, and the first engaging portion 920 of the cartridge 20 is inserted into the through holes serving as the apparatus-side first engaging portions 610. Then, upon the user pressing down the operation portion 910 as indicated by the arrow, the engagement between the first engaging portion 920 and the apparatus-side first engaging portions 610 is fixed.

Figure 7:
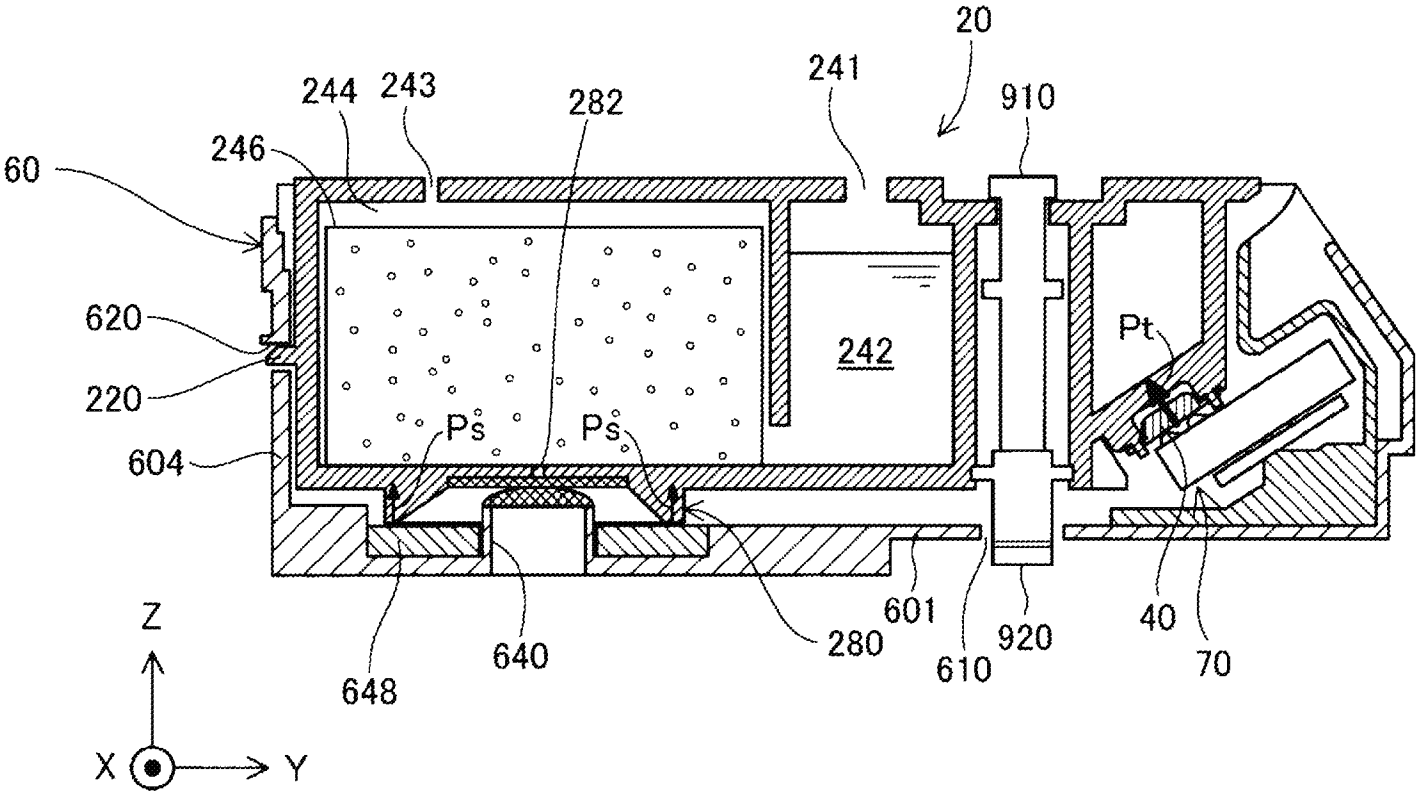
FIG. 7 is a cross-sectional view of a principal part showing a state where the cartridge is attached to the holder.

FIG. 7 is a cross-sectional view of a principal part showing a state where the cartridge 20 is attached to the holder 60. This drawing corresponds to a state where the operation portion 910 has been pressed down in FIG. 6C. In the state where the cartridge 20 is attached into the holder 60, the ink supply port 280 of the cartridge 20 receives biasing force Ps in the +Z direction from the elastic member 648 at the periphery of the ink supply tube 640 of the holder 60. Also, the circuit board 40 of the cartridge 20 receives biasing force Pt in an oblique direction from the contact point mechanism 70. This biasing force Pt has a +Z direction component, and accordingly acts as force that biases the cartridge 20 in the +Z direction ("first direction") together with the biasing force Ps received by the ink supply port 280. The first engaging portion 920 and the second engaging portion 220 of the cartridge 20 have a function of fixing the cartridge 20 in a stable state within the holder 60 against the biasing forces Ps and Pt. Here, the "stable state" means that the ink supply port 280 and the ink supply tube 640 are in communication with each other without leakage, and electrical connection between the circuit board 40 and the contact point mechanism 70 is stable.

Figures 8A, 8B, 8C:
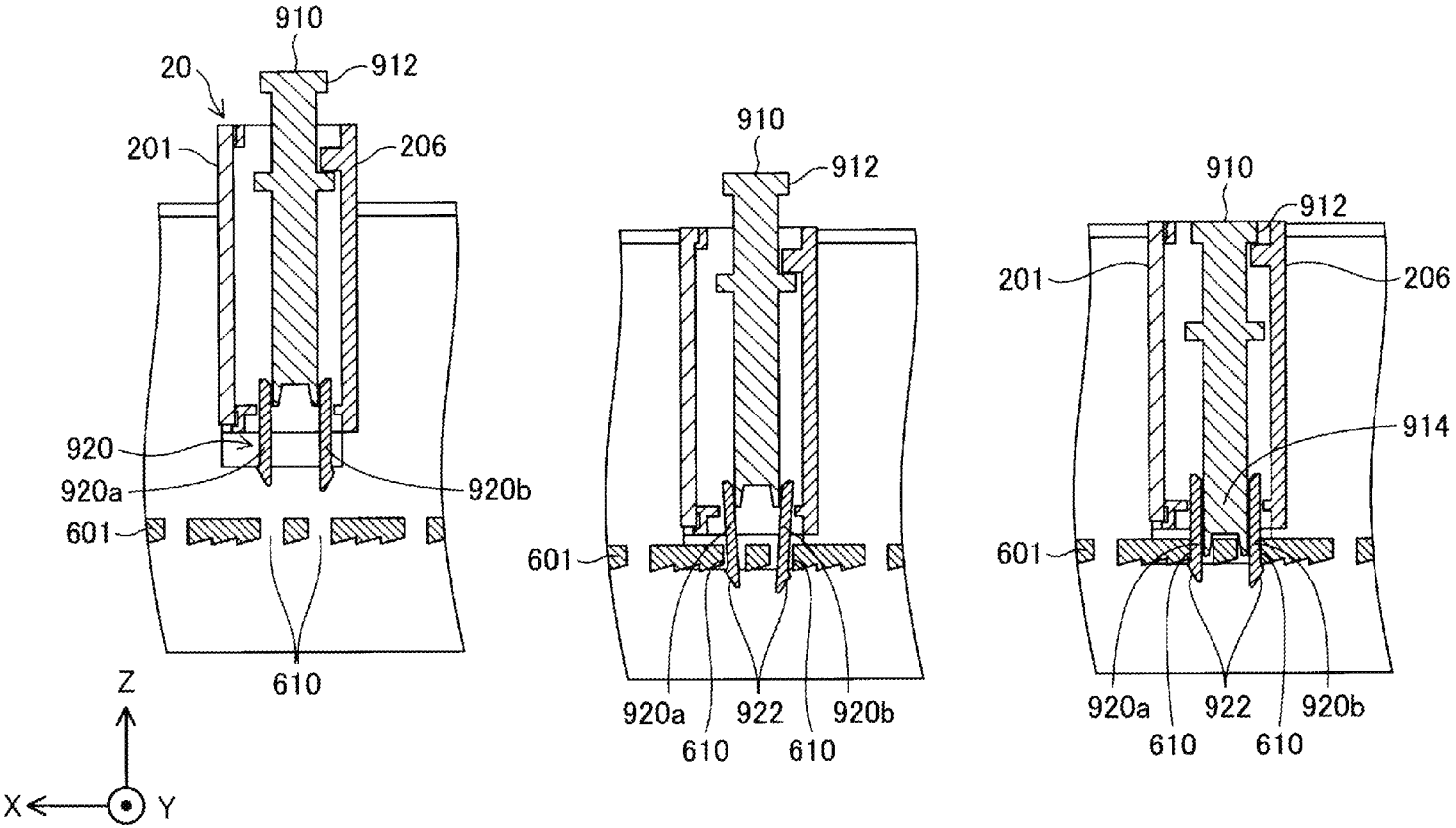
FIGS. 8A to 8C are cross-sectional views of a principal part showing movement of a first engaging portion when attaching the cartridge to the holder.

FIGS. 8A to 8C are cross-sectional views of a principal part showing movement of the first engaging portion 920 when attaching the cartridge 20 into the holder 60. Here, cross-sections in the X and Z directions including the first engaging portion 920 and the operation portion 910 are shown. As the cartridge 20 is lowered into the holder 60, the leg portions 920*a* and 920*b* constituting the first engaging portion 920 of the cartridge 20 are inserted into the through holes of the apparatus-side first engaging portions 610, as shown in FIGS. 8A and 8B. At this time, since the operation portion 910 is retracted on the upper side, the leg portions 920*a* and 920*b* of the first engaging portion 920 enter the through holes of the apparatus-side first engaging portions 610 while pivoting or bending. Thereafter, upon the user pressing down the operation portion 910, the first engaging portion 920 is fixed as shown in FIG. 8C. Specifically, a pressing face, which is an outer face of a fixing portion 914 located at a lower end portion of the operation portion 910, presses pressed faces, which are inner faces of the leg portions 920*a* and 920*b*, and presses the leg portions 920*a* and 920*b* against a part of inner wall faces of the through holes of the apparatus-side first engaging portions 610. Note that, in order to achieve this state, it is preferable that the operation portion 910 is configured such that a tip of the fixing portion 914 reaches a position lower than the upper face of the apparatus-side bottom wall portion 601 of the holder 60 when the operation portion 910 reaches the lower end position thereof. As a result, the leg portions 920*a* and 920*b* of the first engaging portion 920 are sandwiched and fixed between the fixing portion 914 of the operation portion 910 and the inner wall faces of the through holes of the apparatus-side first engaging portions 610. Then, the engaging shape portions 922 provided in the leg portion 920*a* and 920*b* and wall faces at the periphery of the through holes of the apparatus-side first engaging portions 610 are fixed in a locked state. That is to say, the first engaging portion 920 and the apparatus-side first engaging portions 610 engage with each other, and restrict movement of the cartridge 20 in the upward direction (+Z direction). On the other hand, upon the user pulling up the operation portion 910 in the state in FIG.

8C and restoring the state in FIG. 8B, the state of the leg portions 920*a* and 920*b* pressed by the fixing portion 914 is cancelled or released, pivoting or deformation of the leg portions 920*a* and 920*b* is enabled, and the user can lift the cartridge 20.

As described above, in the first embodiment, the engagement structure 900 capable of restricting the upward movement of the cartridge 20 (in the +Z direction) from the holder 60 is provided on the first face 201 that is the bottom face of the cartridge 20. Therefore, the cartridge 20 can be engaged with the holder 60 using a structure different from known structures. Furthermore, as the engagement structure 900, the first engaging portion 920 capable of restricting the upward movement of the cartridge (in the +Z direction) is provided on the first face 201 of the cartridge 20, and the operation portion 910 capable of cancelling the engagement between the first engaging portion 920 and the holder 60 is provided on the second face 202. Therefore, the cartridge 20 can be removed from the holder 60 using a new engagement mechanism that does not exist in known techniques.

Note that it is preferable that the first engaging portion 920 is provided further on the side in the +Y direction than the center position CL20 of the length L20 of the cartridge 20, as shown in FIG. 6C. Here, the "length L20 of the cartridge 20" is the distance between the third face 203 and the fourth face 204. In other words, it is preferable that the first engaging portion 920 is provided at a position closer to the third face 203 than to the fourth face 204. This is because it is desirable to provide the first engaging portion 920 at a position close to the circuit board 40 in order to stabilize the attached state of the cartridge 20 by resisting the biasing force received by the circuit board 40 from the contact point mechanism 70. Furthermore, by providing the first engaging portion 920 at a position close to the circuit board 40, an effect of stabilizing electric contact between the circuit board 40 and the contact point mechanism 70 is achieved. On the other hand, in order to stabilize the attached state of the cartridge 20 against the biasing force received by the ink supply port 280 from the holder 60, it is preferable to provide the second engaging portion 220 at a rear end of the cartridge 20. Furthermore, it is preferable that the ink supply port 280 is located between the first engaging portion 920 and the second engaging portion 220 in the +−Y direction. With this configuration, an engaging state can be achieved where the ink supply port 280 can resist the biasing force received from the holder 60 in a balanced manner. Also, the connection between the ink supply port 280 and the ink supply tube 640 can be made more reliable.

B. Modification of Engagement Structure in the First Embodiment

Figure 9A:
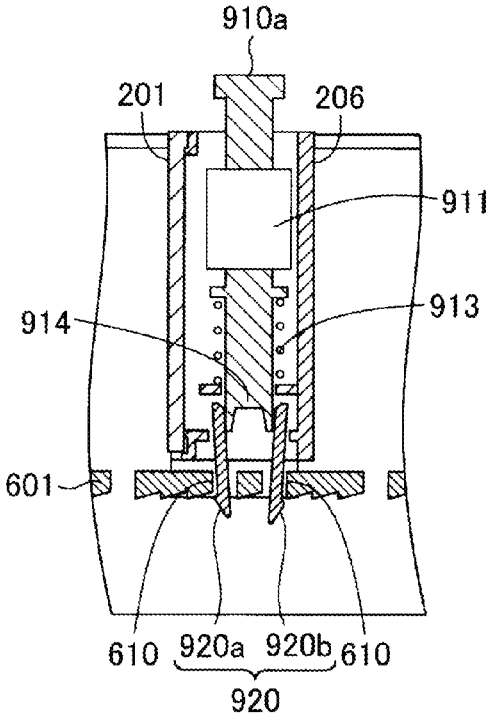
FIGS. 9A and 9B are diagrams showing a modification of an engagement structure in the first embodiment.
Figure 9B:
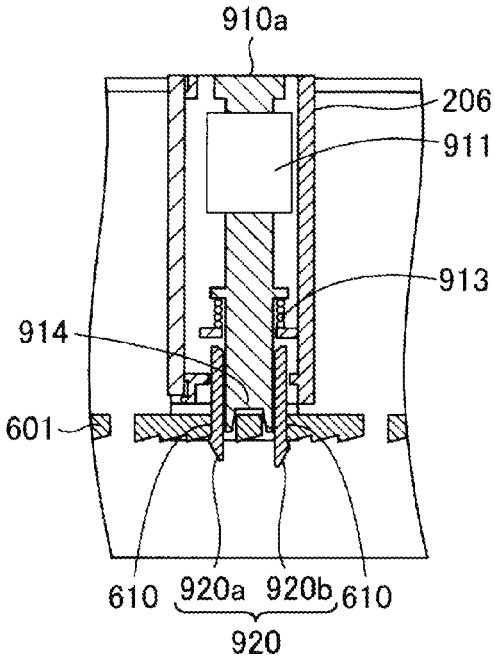

FIGS. 9A and 9B are diagrams showing a modification of the engagement structure in the first embodiment, and correspond respectively to FIGS. 8B and 8C. In this engagement structure, the first engaging portion 920 is the same as that in the first embodiment shown in FIGS. 8A to 8C, whereas the structure and operation of the operation portion 910*a* are different from those in the first embodiment. This operation portion 910*a* has a knock-and-cam mechanism 911 and a spring 913 that biases the fixing portion 914 upward. The knock-and-cam mechanism 911 is a known mechanism that is often used in ball point pens, and is a mechanism that performs an operation in which a tip of a knock bar located at a rear end of the knock-and-cam mechanism 911 projects upon the knock bar being pressed once, and the tip withdraws upon the knock bar being pressed once again. In FIGS. 9A and 9B, an upper end member of the operation portion 910*a* functions as the knock bar. Although the knock-and-cam mechanism 911 also includes a cam body and a rotor in addition to the knock bar, the details thereof will not be shown or described.

With the operation portion 910*a* including this knock-and-cam mechanism 911, upon the upper end of the operation portion 910*a* being pressed once, movement of the first engaging portion 920 is fixed in a state where the leg portions 920*a* and 920*b* of the first engaging portion 920 engage with the apparatus-side first engaging portions 610 as shown in FIG. 9B. Upon the upper end of the operation portion 910*a* being pressed once again, the engagement between the leg portions 920*a* and 920*b* of the first engaging portion 920 and the apparatus-side first engaging portions 610 is cancelled as shown in FIG. 9A. Accordingly, the user can easily execute fixation and cancellation of the engagement between the first engaging portion 920 and the apparatus-side first engaging portions 610 only by performing the operation of pressing the upper end of the operation portion 910*a*.

Figure 10A:
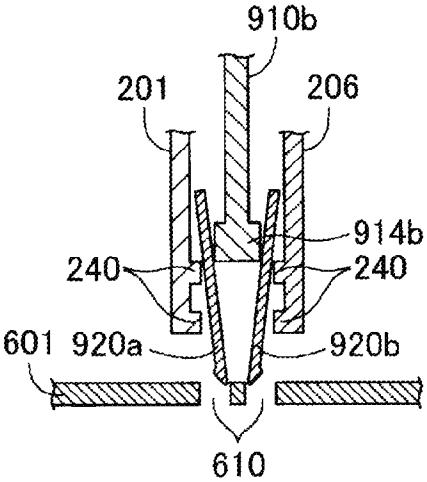
FIGS. 10A to 10C are diagrams showing another modification of the engagement structure in the first embodiment.
Figure 10B:
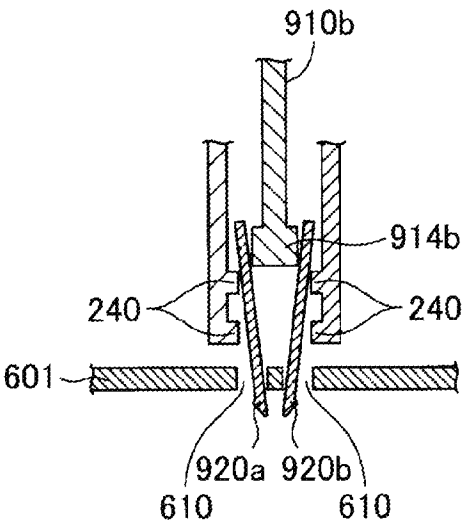
Figure 10C:
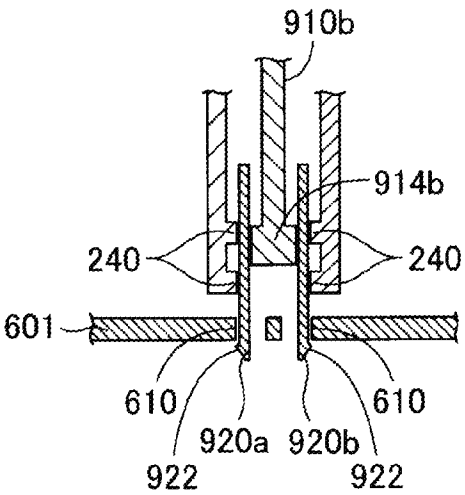

FIGS. 10A to 10C are diagrams showing another modification of the engagement structure in the first embodiment, and correspond respectively to FIGS. 8A to 8C. Note that the shape of each member is simplified in FIGS. 10A to 10C. A difference from the engagement structure shown in FIGS. 8A to 8C lies in that a plurality of projections 240 are provided on both sides of inner faces of the wall portions 205 and 206 of the cartridge 20 in an opposed manner, and that the thickness of a fixing portion 914*b* at the lower end of an operation portion 910*b* is large. In this modification, upon the operation portion 910*b* being pressed down, as shown in FIG. 10C, the leg portions 920*a* and 920*b* of the first engaging portion 920 are sandwiched between the fixing portion 914*b* at the lower end of the operation portion 910*b* and the projections 240, and brought into a fixed state. As a result, the leg portions 920*a* and 920*b* are fixed in a state where the engaging shape portions 922 provided in the leg portions 920*a* and 920*b* engage with the apparatus-side first engaging portions 610. On the other hand, in the first embodiment shown in FIGS. 8A to 8C, the leg portions 920*a* and 920*b* are fixed between the fixing portion 914 and the inner wall faces of the through holes of the apparatus-side first engaging portions 610, which is different from the modification in FIGS. 10A to 10C. However, both achieve roughly similar effects.

Figure 11A:
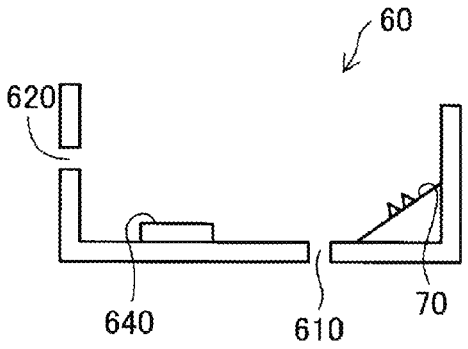
FIGS. 11A to 11C are diagrams showing yet another modification of the engagement structure in the first embodiment.
Figure 11B:
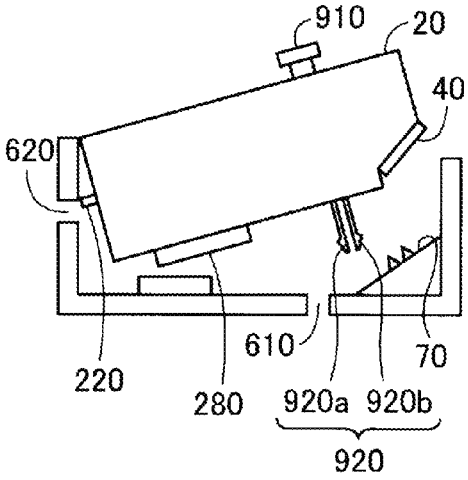
Figure 11C:
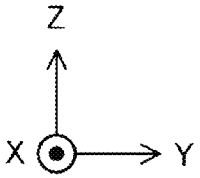
Figure 11C:
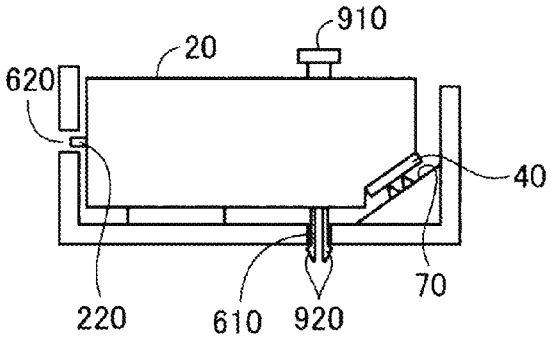

FIGS. 11A to 11C are diagrams showing yet another modification of the engagement structure in the first embodiment, and correspond respectively to FIGS. 6A to 6C. A major difference from the engagement structure in the first embodiment shown in FIGS. 6A to 6C lies in that the two leg portions 920*a* and 920*b* of the first engaging portion 920 are provided side-by-side in the Y direction. On the other hand, in the first embodiment, the two leg portions 920*a* and 920*b* are arranged side-by-side in the X direction. The engagement structure shown in FIGS. 11A to 11C also achieves effects that are roughly similar to those of the first embodiment. Note that the first engaging portion 920 does not need to have the two leg portions 920*a* and 920*b*, and may have only one leg portion 920*a* (or 920*b*). The first engaging portion 920 need only have a structure capable of engaging with the apparatus-side first engaging portions 610 of the holder 60, and may have a member having a shape or structure other than that of the leg portions 920*a* and 920*b*.

As can be understood from the above description of FIGS. 8A to 11C, it is possible to use, as the engagement structure 900, various mechanisms capable of fixing the movement of the first engaging portion 920 provided on the first face 201 and cancelling the engagement thereof, using the operation portion 910 provided on the second face 202 of the cartridge 20.

Figure 12A:
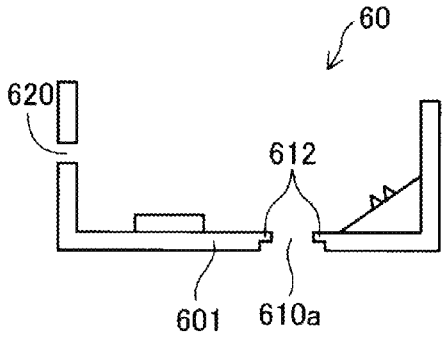
FIGS. 12A to 12D are diagrams showing various modifications of an apparatus-side first engaging portion.
Figure 12B:
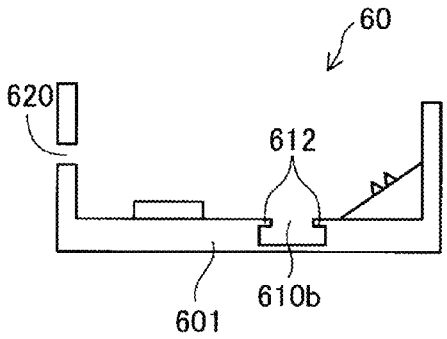
Figure 12C:
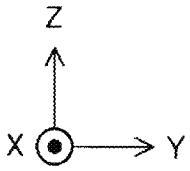
Figure 12C:
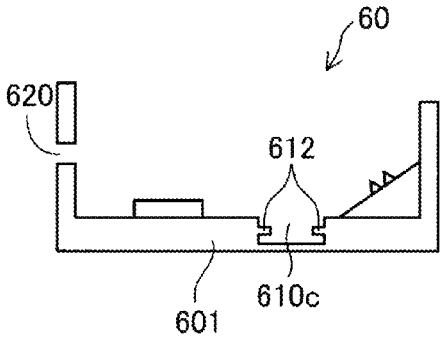
Figure 12D:
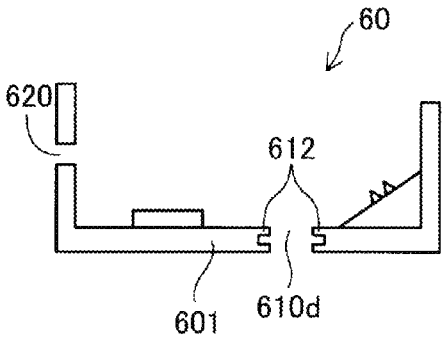

FIGS. 12A to 12D are diagrams showing various modifications of the apparatus-side first engaging portion 610, and each correspond to FIG. 6A. The apparatus-side first engaging portions 610 described using FIG. 6A are each formed as a through hole that penetrates with the same cross-sectional shape through the entire thickness of the apparatus-side bottom wall portion 601. An apparatus-side first engaging portion 610*a* in FIG. 12A is formed as a through hole having a step in the thickness direction of the apparatus-side bottom wall portion 601, and a thin member 612 that demarcates the through hole is formed on the innermost wall face of the apparatus-side first engaging portion 610*a*. In this case as well, the engaging shape portions 922 (FIG. 2) of the first engaging portion 920 can engage with the wall face (or an edge) of the thin member 612. This also applies to FIGS. 12B to 12D. An apparatus-side engaging portion 610*b* in FIG. 12B is formed as a recess portion recessed in a direction (−Z direction) extending from the inner face toward the outer face of the apparatus-side bottom wall portion 601. In this case, the first engaging portion 920 is locked at a wall face (or an edge) of the thin member 612 formed on the innermost wall face of the recess portion of the apparatus-side bottom wall portion 601. An apparatus-side engaging portion 610*c* in FIG. 12C is also formed as a recess portion recessed in a direction (−Z direction) extending from the inner face toward the outer face of the apparatus-side bottom wall portion 601, which is similar to FIG. 12B, but is different from FIG. 12B in that the thin member 612 demarcating the periphery of the through hole is formed at the center of the depth of the recess portion. In FIG. 12D, a through hole is also formed in FIG. 12B, on the bottom face below an apparatus-side first engaging portion 610*d*. As can be understood from the description of FIGS. 12A to 12D, the through hole constituting the apparatus-side first engaging portion 610 is formed as a space through which the first engaging portion 920 passes from the inner face to the outer face. Here, the "inner face" is a face of the apparatus-side bottom wall portion 601 of the holder 60, the face facing the side (in the +Z direction) of the cartridge 20, and the "outer face" is a face facing the opposite side (in the −Z direction). Note that these various shapes of the apparatus-side first engaging portion 610 are also applicable to a second embodiment described below.

C. Second Embodiment

Figure 13:
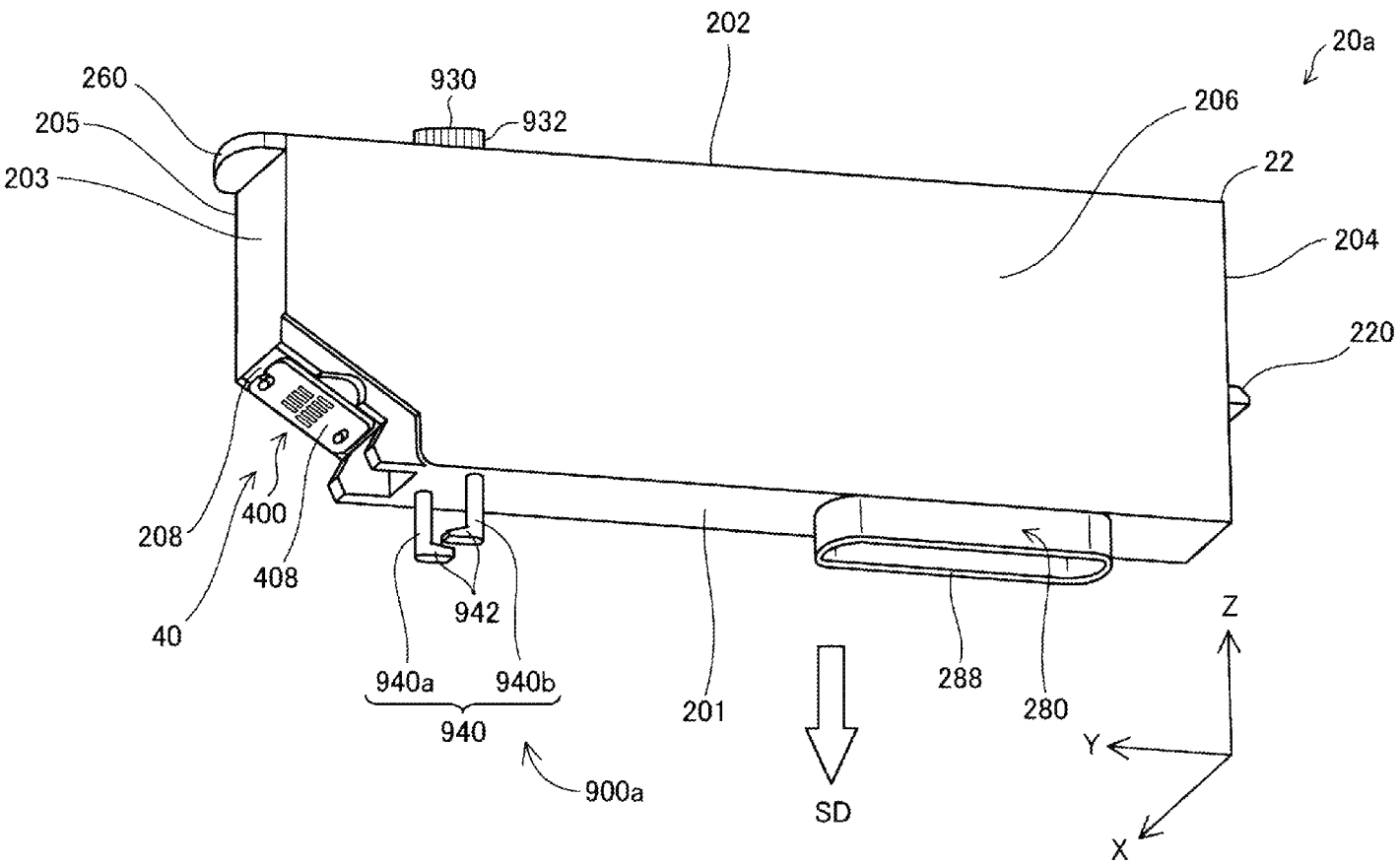
FIG. 13 is a perspective view of an ink cartridge in a second embodiment.

FIG. 13 is a perspective view of a cartridge 20*a* in a second embodiment, and is a diagram corresponding to FIG. 2 in the first embodiment. A difference from the first embodiment lies in that the structure and operation of a first engaging portion 940 and an operation portion 930 in an engagement structure 900*a* are different. The other structure of the cartridge 20*a* is roughly the same as that in the first embodiment shown in FIG. 2, and accordingly a description thereof will be omitted.

A first engaging portion 940 includes a first leg portion 940*a* and a second leg portion 940*b* that project in the −Z direction from the first face 201 of the cartridge 20*a*. The leg portions 940*a* and 940*b* each have an engaging shape portion 942 at the lower end thereof. The engaging shape portions 942 have shapes projecting in directions orthogonal to the respective leg portions 940*a* and 940*b*. These engaging shape portions 942 engage with the through holes of the apparatus-side first engaging portions 610 within the holder 60 in a state where the cartridge 20*a* is attached to the holder 60, and thereby restrict movement of the cartridge 20*a* in the +Z direction. The operation portion 930 is provided on the second face 202 of the cartridge 20*a*. This operation portion 930 is a member to be operated by a user, and is used when fixing the engagement between the first engaging portion 940 and the apparatus-side first engaging portions 610, and cancelling the engagement. The operation portion 930 is provided on the second face 202 and can be easily operated by the user, similarly to the first embodiment. However, unlike the operation portion 910 (FIG. 2) in the first embodiment, this operation portion 930 fixes and cancels the engaging state of the first engaging portion 940 by the user rotating a head portion 932 thereof.

Figure 14:
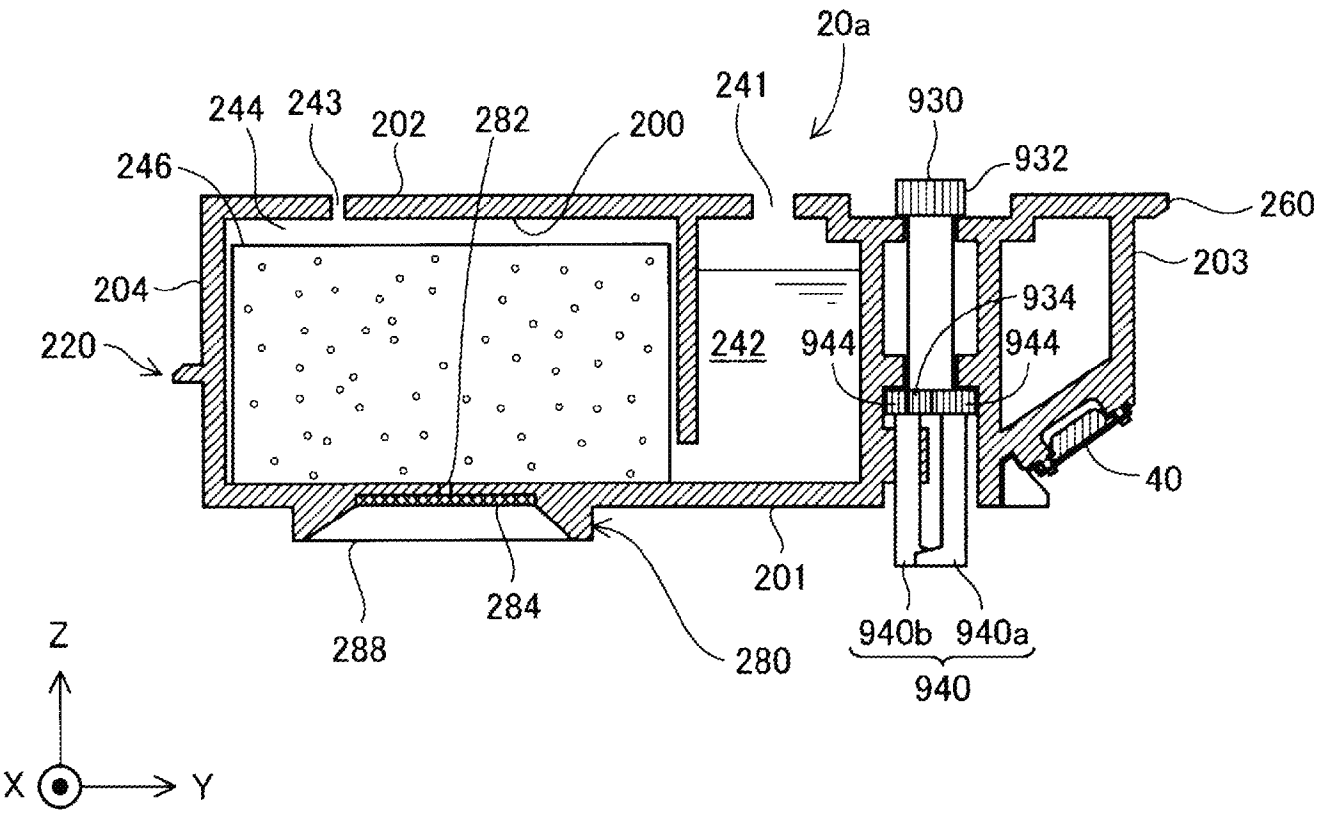
FIG. 14 is a cross-sectional view of a principal part of the ink cartridge in the second embodiment.

FIG. 14 is a cross-sectional view of a principal part of the cartridge 20*a* in the second embodiment, and is a diagram corresponding to FIG. 3 in the first embodiment. Note that FIG. 14 shows the outer shape, rather than the cross-section, of the first engaging portion 940 and the operation portion 930 as viewed from the X direction, for the sake of convenience of the drawing. Each of the leg portions 940*a* and 940*b* of the first engaging portion 940 is a bar-shaped member extending in the Z direction, has a gear 944 formed at the upper end thereof, and has the engaging shape portion 942 at the lower end thereof. The engaging shape portions 942 have shapes projecting in directions orthogonal to the respective leg portions 940*a* and 940*b*, and an upper face of each engaging shape portion 942 inclines obliquely downward. The operation portion 930 is a bar-shaped member extending in the Z direction, provided at the upper end thereof with the head portion 932 to be operated by fingers of the user, and has a gear 934 formed at the lower end thereof. The gear 934 of the operation portion 930 meshes with the gears 944 of the two leg portions 940*a* and 940*b*. Accordingly, upon the user rotating the head portion 932 of the operation portion 930, the gears 934 and 944 rotate, and the leg portions 940*a* and 940*b* accordingly rotate.

Figures 15A, 15B, 15C:
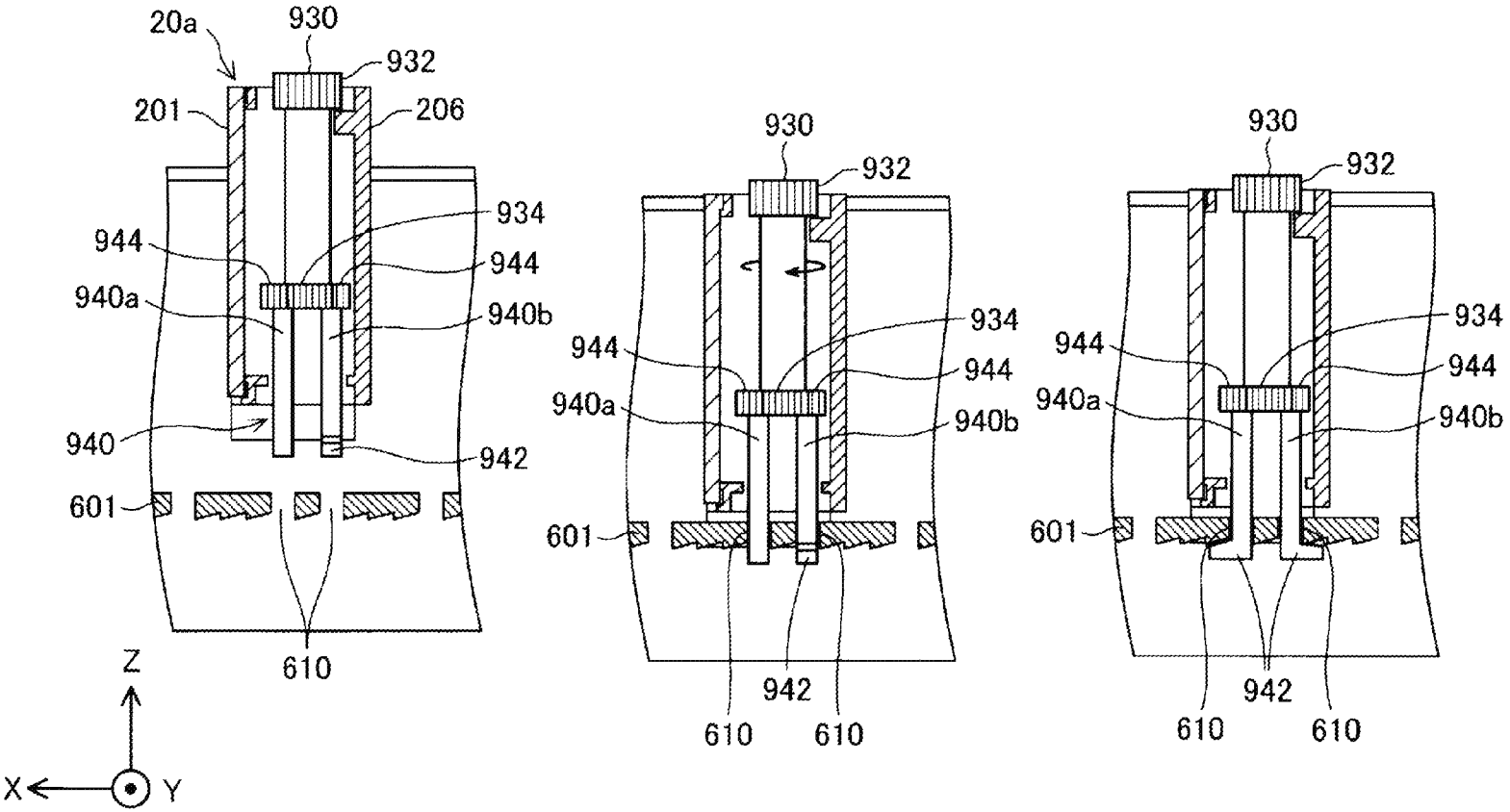
FIGS. 15A to 15C are cross-sectional views of a principal part showing movement of a first engaging portion when attaching the cartridge to the holder in the second embodiment.

FIGS. 15A to 15C are cross-sectional views of a principal part showing movement of the first engaging portion 940 when attaching the cartridge 20*a* into the holder 60, and is a diagram corresponding to FIGS. 8A to 8C in the first embodiment. Upon lowering the front end side of the cartridge 20*a*, the leg portions 940*a* and 940*b* of the first engaging portion 940 of the cartridge 20*a* are inserted into the through holes of the apparatus-side first engaging portions 610 as shown in FIGS. 15A and 15B. At this time, the engaging shape portions 942 of the two leg portions 940*a* and 940*b* face in the Y direction, which corresponds to the long direction (FIG. 4) of the through holes of the apparatus-side first engaging portions 610, and therefore the engaging shape portions 942 enters the through holes of the apparatus-side first engaging portions 610 as-is. After FIG. 15B, upon the user rotating the operation portion 930 in a prescribed first rotation direction, the leg portions 940*a* and 940*b* of the first engaging portion 940 rotate and are fixed as shown in FIG. 15C. Specifically, upon the operation portion 930 rotating, the gears 934 and 944 also rotate, and the leg portions 940*a* and 940*b* accordingly rotate by 90 degrees. As a result, the engaging shape portions 942 of the leg portions 940*a* and 940*b* face in the X direction, which corresponds to the short direction of the through holes of the apparatus-side first engaging portions 610, and accordingly the upper faces of the engaging shape portions 942 come into contact with the lower face of a wall member at the periphery of the through holes of the apparatus-side first engaging portions 610 and is brought into a fixed state. That is to say, the first engaging portion 940 and the apparatus-side first engaging portions 610 engage with each other, and can restrict movement of the cartridge 20*a* in the upward direction (+Z direction). In the state in FIG. 15C, upon the user rotating the operation portion 930 in a second rotation direction opposite to the first rotation direction to restore the state in FIG. 15B, the engaging state between the leg portions 940*a* and 940*b* and the apparatus-side first engaging portions 610 is cancelled, and the cartridge 20*a* can be lifted.

As described above, in the second embodiment as well, the engagement structure 900*a* (FIG. 13) capable of restricting the upward movement (in the +Z direction) of the cartridge 20*a* from the holder 60 is provided on the first face 201 of the cartridge 20*a*, and accordingly the cartridge 20*a* can be engaged with the holder 60 using a structure different from known structures. Furthermore, as the engagement structure 900*a*, the first engaging portion 940 capable of restricting the upward movement (in the +Z direction) of the cartridge 20*a* is provided on the first face 201, and the operation portion 930 capable of cancelling the engagement between the first engaging portion 940 and the holder 60 is provided on the second face 202. Therefore, the cartridge 20*a* can be removed from the holder 60 by a new engagement mechanism that does not exist in known techniques.

Although the operation portion 930 is linked to the leg portions 940*a* and 940*b* by the gears 934 and 944 in FIGS. 14 and 15A to 15C, it should be noted that, alternatively, the operation portion 930 and the leg portions 940*a* and 940*b* may be integrally molded, while omitting the gears 934 and 944. In this mode as well, the orientation of the engaging shape portions 942 at the lower ends of the leg portions 940*a* and 940*b* can be rotated to fix and cancel the state of engagement with the apparatus-side first engaging portions 610 by rotating the operation portion 930. In this specification, the term "link" between the operation portion 930 and the leg portions 940*a* and 940*b* has meanings including both the case where the operation portion 930 and the leg portions 940*a* and 940*b* are separately formed and liked to each other via some kind of joint portion, and the case where the operation portion 930 and the leg portions 940*a* and 940*b* are integrally molded.

D. Modifications of Outer Shape of Cartridge

FIGS. 16A to 16F are conceptual diagrams showing shapes of the cartridge in other embodiments. Note that FIGS. 16A to 16F omit the engagement structure 900 for the sake of convenience of the drawings. An outer shell 22*c* of a cartridge 20*c* shown in FIG. 16A has an ellipse or oblong side wall. The cartridge 20*c* has the circuit board 40 on the front face side. The ink supply port 280 is formed on the bottom face side of the cartridge 20*c*, and the second engaging portion 220 is formed on the back face side. Note that this cartridge 20*c* has a fixed width as viewed from the front face side. This cartridge 20*c* can also be compatible with the cartridges 20 and 20*a* in the above-described embodiments if the circuit board 40 and the ink supply port 280 are configured to be connected to corresponding members of the printer 50.

Figures 16A, 16B, 16C, 16D, 16E, 16F:
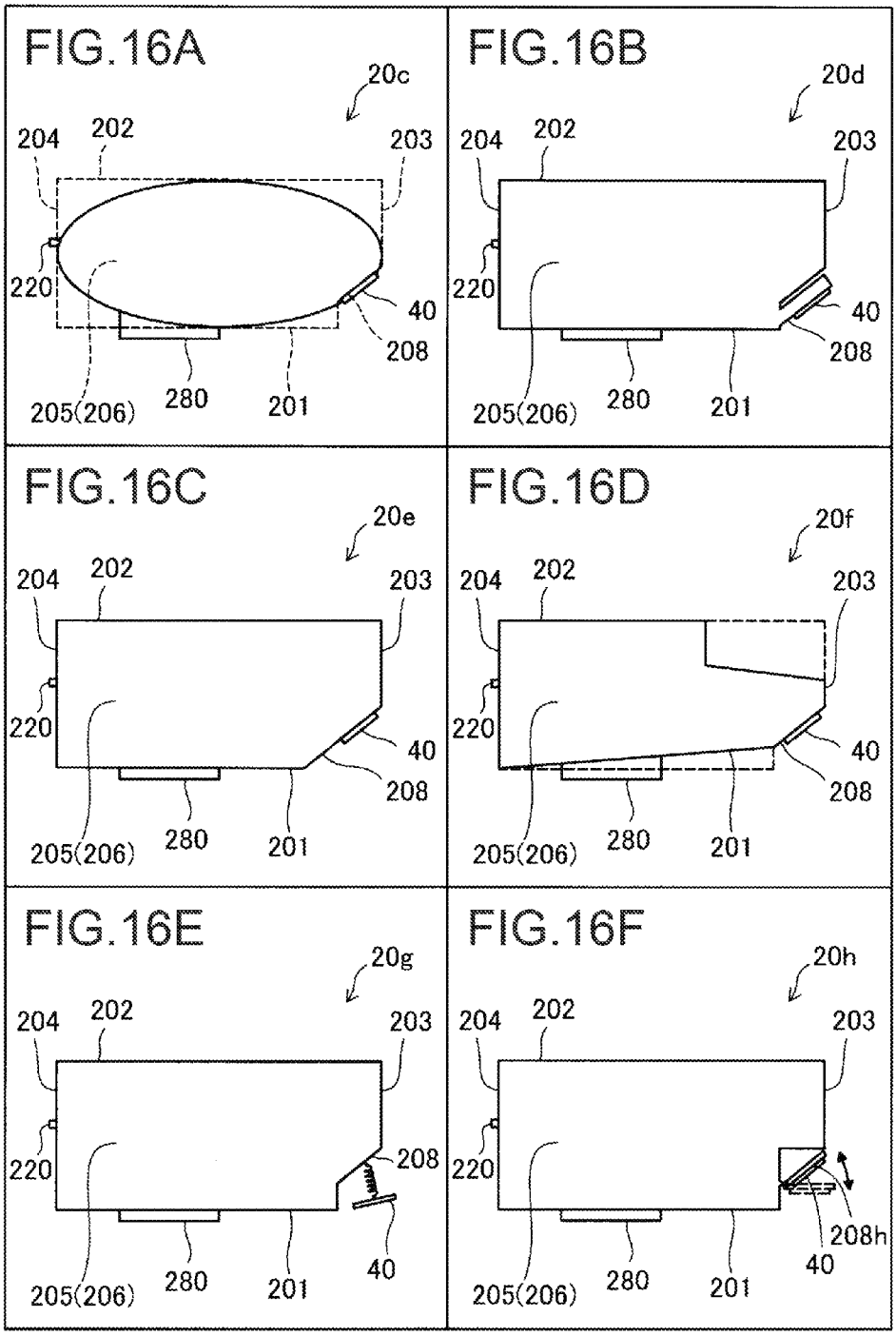
FIGS. 16A to 16F are conceptual diagrams showing modifications of the outer shape of the cartridge.

A cartridge 20*d* shown in FIG. 16B has a substantially rectangular parallelepiped shape as in FIGS. 2 and 13. A major difference from the cartridge 20 in FIG. 2 lies in that the eighth face 208 is not provided continuously with the lower end of the third face 203. Cartridges 20*e* and 20*f* shown respectively in FIGS. 16C and 16D are different from the cartridge 20 in FIG. 2 in that the cartridges 20*e* and 20*f* do not have the seventh face. In a cartridge 20*g* shown in FIG. 16E, the circuit board 40 is attached to the eighth face 208 via a spring. In a cartridge 20*h* shown in FIG. 16F, a face 208*h*, which corresponds to the eighth face 208, is movable, and the circuit board 40 is provided on this face 208*h*. In these cartridges 20*c* to 20*g* as well, the circuit board 40 and the ink supply port 280 are configured to be connected to corresponding members of the printer 50, and the cartridges 20*c* to 20*g* can also be compatible with the cartridges 20 and 20*a* in the above-described embodiments.

As can be understood from various examples shown in FIGS. 16A to 16F, various modifications are conceivable for the outer shape of the cartridge. In the case where the outer shape of the cartridge is other than the substantially rectangular parallelepiped shape as well, it is possible to virtually consider, as indicated by dotted lines in FIGS. 16A and 16D, for example, six faces of a substantial rectangular parallelepiped, i.e., the bottom face 201 (first face), the upper face 202 (second face), the front face 203 (third face), the back face 204 (fourth face), the left side face 205 (fifth face), and the right side face 206 (sixth face) shown in FIG. 2. In this specification, the term "face" (plane) can be used as a term to mean both such virtual faces (also called nonexistent faces) and existing faces such as those shown in FIG. 2. Also, the term "face" is used as a term to mean both a flat face and a curved face.

Modifications

Note that the invention is not limited to the above examples and embodiments, and may be implemented in various modes without departing from the gist of the invention. For example, the following modifications are possible.

Modification 1

The shapes and structures of each member of the engagement structures 900 and 900*a* in the above-described embodiments are merely examples, and engagement structures having various other shapes and structures are available. In this case as well, it is preferable that the engagement structure of the cartridge has a configuration capable of restricting movement of the cartridge in a direction (+Z direction) extending from the first face 201 toward the second face 202 within the holder 60, and in particular, it is preferable that a part of the engagement structure projects downward (in the −Z direction) from the first face 201.

Modification 2

In the above-described embodiments and modifications, configurations and members other than the engagement structures 900 and 900*a* can also be altered or omitted as appropriate in accordance with the purpose or use. For example, although the second engaging portion 220 is provided on the fourth face 204 of the cartridge 20 in the above-described embodiments and modifications, the second engaging portion 220 may be provided on the other faces (e.g., the first face 201 or the second face 202). Also, the second engaging portion 220 may be omitted. However, if the second engaging portion 220 is provided, the cartridge 20 can be more reliably engaged with the holder 60 using both the first engaging portion 920 (or 940) and the second engaging portion 220. Also, in the above-described embodiments and modifications, the circuit board 40 (electric terminal portion) may be omitted.

Modification 3

The configuration of the cartridges in the above-described embodiments and modifications can be divided into an ink containing chamber member having an ink containing chamber (liquid containing chamber) and an adapter. The ink containing chamber member and the adapter are attached to the holder 60 in a combined state. In this case, it is preferable to provide, in the adapter, at least one of the second engaging portion 220 and the engagement structure 900 (or 900*a*) including the first engaging portion 920 (or 940). In this specification, the configuration divided into the ink containing chamber member and the adapter is also encompassed in the term "ink supply unit" or "liquid supply unit".

Modification 4

The invention is applicable not only to inkjet printers and ink cartridges thereof, but also to any liquid ejection apparatuses that eject liquid other than ink and liquid supply units attached to holders of these apparatuses. For example, the invention is applicable to various liquid ejection apparatuses and liquid supply units attached to holders of these apparatus as listed below.

(1) Image recording apparatuses such as a facsimile apparatus (2) Color material ejection apparatuses used to manufacture color filters for image display apparatuses such as a liquid crystal display (3) Electrode material ejection apparatuses used to form electrodes for organic EL (Electro Luminescence) displays, field emission displays (FED), and the like (4) Liquid ejection apparatuses that eject liquid containing biological organic matter used to manufacture biochips (5) Sample ejection apparatuses serving as precision pipettes (6) Lubricating oil ejection apparatuses (7) Resin solution ejection apparatuses (8) Liquid ejection apparatuses that perform pinpoint ejection of lubricating oil to precision machines such as a watch and a camera (9) Liquid ejection apparatuses that eject transparent resin solution such as UV-cured resin solution onto substrates in order to form micro-hemisphere lenses (optical lenses) used in optical communication elements and the like

(10) Liquid ejection apparatuses that eject acid or alkaline etchant in order to etch substrates and the like

(11) Liquid ejection apparatuses including liquid ejection heads for discharging a very small amount of any other kinds of droplet Note that the "droplet" refers to a state of the liquid discharged from a liquid ejection apparatus, and includes droplets having a granular shape, a tear-drop shape, and a shape having a thread-like trailing end. Furthermore, the "liquid" mentioned here need only be any kind of material that can be ejected by a liquid ejection apparatus. For example, the "liquid" need only be a material in a state where a substance is in a liquid phase, and a liquid material having a high or low viscosity, sol, gel water, and other liquid materials such as inorganic solvent, organic solvent, solution, liquid resin, and liquid metal (metallic melt) are also included in the "liquid". Furthermore, the "liquid" is not limited to being a one-state substance, and also includes particles of a functional material made from solid matter, such as pigment or metal particles, that are dissolved, dispersed, or mixed in a solvent, and the like. Representative examples of the liquid include ink such as that described in the above embodiments, liquid crystal, and the like. Here, the "ink" encompasses general water-based ink and oil-based ink, as well as various types of liquid compositions such as gel ink and hot melt-ink.

Although the embodiments of the invention have been described above based on some examples, the above-described embodiments of the invention is for facilitating understanding of the invention, and is not intended to limit the invention. Needless to say, the invention can be altered and improved without departing from the gist and the claims of the invention, and the invention encompasses equivalents thereof.

What is claimed is:

1. A liquid supply unit to be attached to an on-carriage holder of a liquid ejection apparatus, the liquid supply unit comprising:

a first face;

a second face opposed to the first face;

a third face intersecting the first face and the second face;

a fourth face intersecting the first face and the second face and opposed to the third face;

a liquid supply portion projecting from the first face in a direction extending from the second face toward the first face, the liquid supply portion being biased in a direction extending from the first face toward the second face by the on-carriage holder in a state where the liquid supply unit is attached to the on-carriage holder; and an engagement structure including, a first engaging portion that projects from the first face in the direction extending from the second face toward the first face, the first engaging portion engaging with the on-carriage holder so as to restrict movement of the liquid supply unit in the direction extending from the first face toward the second face within the on-carriage holder in the state where the liquid supply unit is attached to the on-carriage holder, and an operation portion exposed from the second face, the operation portion being adapted to cancel engagement between the first engaging portion and the on-carriage holder.

2. The liquid supply unit according to claim 1, further comprising:

a second engaging portion projecting from the fourth face in a direction extending from the third face toward the fourth face, the second engaging portion adapted to restrict movement of the liquid supply unit in the direction extending from the first face toward the second face within the on-carriage holder in the state where the liquid supply unit is attached to the on-carriage holder.

3. The liquid supply unit according to claim 1, further comprising:

an electric terminal portion arranged between the first face and the third face, wherein the electric terminal portion is biased in the direction extending from the first face toward the second face by the on-carriage holder in the state where the liquid supply unit is attached to the on-carriage holder, and the first engaging portion is located between the liquid supply portion and the electric terminal portion in a direction extending from the third face toward the fourth face.

4. The liquid supply unit according to claim 1, wherein the first engaging portion has a first leg portion, the first leg portion has a first engaging shape portion adapted to restrict movement of the liquid supply unit in the direction extending from the first face toward the second face within the on-carriage holder in the state where the liquid supply unit is attached to the on-carriage holder; and the operation portion is adapted to cancel engagement between the first engaging shape portion and the on-carriage holder.

5. The liquid supply unit according to claim 4, wherein the first engaging portion further has a second leg portion, the second leg portion has a second engaging shape portion adapted to restrict movement of the liquid supply unit in the direction extending from the first face toward the second face within the on-carriage holder in the state where the liquid supply unit is attached to the on-carriage holder; and the operation portion is adapted to cancel engagement between the second engaging shape portion and the on-carriage holder.

6. The liquid supply unit according to claim 4, wherein in the state where the liquid supply unit is attached to the on-carriage holder, the first leg portion is pressed and fixed as a result of the operation portion being moved in the direction extending from the second face toward the first face, and the first leg portion is released from a pressed state and fixation is cancelled as a result of the operation portion being moved in the direction extending from the first face toward the second face.

7. The liquid supply unit according to claim 4, wherein the operation portion is linked to the first leg portion, and in the state where the liquid supply unit is attached to the on-carriage holder, as a result of the operation portion being rotated in a first rotation direction, the first leg portion is rotated, and the first engaging shape portion is moved to a position at which the first engaging shape portion engages with the on-carriage holder, and as a result of the operation portion being rotated in a second rotation direction opposite to the first rotation direction, the first leg portion is rotated, and the first engaging shape portion is moved to a position at which the first engaging shape portion does not engage with the on-carriage holder.

* * * * *